US011281130B2

(12) United States Patent
Kakehi et al.

(10) Patent No.: US 11,281,130 B2
(45) Date of Patent: Mar. 22, 2022

(54) IMAGE FORMING APPARATUS

(71) Applicant: CANON KABUSHIKI KAISHA, Tokyo (JP)

(72) Inventors: Yutaka Kakehi, Kashiwa (JP); Tetsuya Ohta, Abiko (JP); Yusuke Minato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/952,254

(22) Filed: Nov. 19, 2020

(65) Prior Publication Data

US 2021/0072673 A1 Mar. 11, 2021

Related U.S. Application Data

(63) Continuation of application No. PCT/JP2019/021440, filed on May 23, 2019.

(30) Foreign Application Priority Data

May 25, 2018 (JP) ..... JP2018-101059
Oct. 15, 2018 (JP) ..... JP2018-194691

(51) Int. Cl.
*G03G 15/16* (2006.01)
*G03G 15/00* (2006.01)

(52) U.S. Cl.
CPC ..... *G03G 15/1675* (2013.01); *G03G 15/5029* (2013.01); *G03G 2215/00738* (2013.01)

(58) Field of Classification Search
CPC ..... G03G 15/1605; G03G 15/1675
See application file for complete search history.

(56) References Cited

U.S. PATENT DOCUMENTS 8,265,499 B2 9/2012 Sueoka
9,146,507 B2 9/2015 Mochizuki
(Continued)

FOREIGN PATENT DOCUMENTS

JP 2004-117920 A 4/2004
JP 4161005 B2 10/2008
(Continued)

OTHER PUBLICATIONS

International Search Report and Written Opinion dated Jul. 17, 2019, in International Application No. PCT/JP2019/021440.
(Continued)

*Primary Examiner* — Thomas S Giampaolo, II
(74) *Attorney, Agent, or Firm* — Venable LLP

(57) ABSTRACT

An image forming apparatus includes an image bearing member, an intermediary transfer belt, a transfer member, a voltage source for applying a voltage to the transfer member, a detecting portion for detecting a current flowing through the transfer member, and a controller for carrying out constant-voltage control so that the voltage applied to the transfer member becomes a target voltage when a recording material P passes through a transfer portion. The controller is capable of changing the voltage applied to the transfer member so that a detection result detected by the detecting portion during transfer falls within a predetermined range. The controller changes the predetermined range on the basis of the detection result detected by the detecting portion when the voltage is applied to the transfer member in a state in which the recording material P is absent in the transfer portion.

28 Claims, 17 Drawing Sheets

(56) References Cited

U.S. PATENT DOCUMENTS

| | | | | |
|---|---|---|---|---|
| 9,250,574 | B2 | 2/2016 | Nakaegawa et al. | |
| 9,304,450 | B2 | 4/2016 | Matsuura | |
| 10,234,797 | B2 | 3/2019 | Aiba | |
| 2011/0044710 | A1 | 2/2011 | Shida | |
| 2013/0330096 | A1* | 12/2013 | Mochizuki ..... | G03G 15/1645 399/66 |
| 2015/0378283 | A1 | 12/2015 | Takahashi | |
| 2018/0253039 | A1 | 9/2018 | Kakehi | |
| 2020/0050133 | A1 | 2/2020 | Ohta et al. | |

FOREIGN PATENT DOCUMENTS

| | | | |
|---|---|---|---|
| JP | 2008-275946 | A | 11/2008 |
| JP | 2010-191276 | A | 9/2010 |
| JP | 2013-254064 | A | 12/2013 |
| JP | 2015-038580 | A | 2/2015 |
| JP | 2017-207764 | A | 11/2017 |
| JP | 2018-010140 | A | 1/2018 |

OTHER PUBLICATIONS

Extended European Search Report dated Jan. 26, 2022, in European Patent Application No. 19807220.9.

* cited by examiner

| | | AMBIENT WATER CONTENT (g/kg) | | | | |
|---|---|---|---|---|---|---|
| | | ≤0.9 | … | 8.9 | … | |
| PAPER BASIS WEIGHT (g/m²) | · | · | | · | | · |
| | · | · | | · | | · |
| | 81～100 | 1000V | … | 500V | … | 200V |
| | 101～125 | 1150V | … | 600V | … | 250V |
| | 126～150 | 1300V | … | 700V | … | 300V |
| | · | · | | · | | · |
| | · | · | | · | | · |

| A4 SIZE | AMBIENT WATER CONTENT (g/kg) | | | | | | |
|---|---|---|---|---|---|---|---|
| | ≤0.9 | 1.73 | 5.8 | 8.9 | 15 | 18.5 | 21.5≤ |
| UPPER CURRENT | 20 | … | … | 20 | … | … | 30 |
| LOWER CURRENT | 15 | … | … | 13 | … | … | 12 |

| A4 SIZE | AMBIENT WATER CONTENT (g/kg) | | | | | | |
|---|---|---|---|---|---|---|---|
| | ≤0.9 | 1.73 | 5.8 | 8.9 | 15 | 18.5 | 21.5≤ |
| S.P.P CURRENT | 18 | … | … | 18 | … | … | 25 |

(a) UPPER & LOWER CURRENT VALUES (UNIT: μA)

| | A4 SIZE | | A5 SIZE | |
|---|---|---|---|---|
| | UPPER LIMIT | LOWER LIMIT | UPPER LIMIT | LOWER LIMIT |
| I_SPP | 20 | 15 | 10 | 7.5 |
| I_NSPP | 4.4 | 3.6 | 20.3 | 16.6 |
| CURRENT (TOTAL) | 24.4 | 18.6 | 30.3 | 24.1 |

(b) PROPER CURRENT VALUES (UNIT: μA)

| | A4 SIZE | | A5 SIZE | |
|---|---|---|---|---|
| | UPPER LIMIT | LOWER LIMIT | UPPER LIMIT | LOWER LIMIT |
| I_SPP | 20 | 15 | 10 | 7.5 |
| I_NSPP | 5 | 4.2 | 23.1 | 19.4 |
| CURRENT (TOTAL) | 25 | 19.2 | 33.1 | 26.9 |

Fig. 11

| | I_SPP (μA) | | | |
|---|---|---|---|---|
| | 10 | 15 | 20 | 25 |
| INITIAL (W. C. : 4%) | ○ | ○ | ○ | × |
| AFTER L. S. (W. C. : 1. 5%) | ○ | × | × | × |

Fig. 12

| PAPER CATEGORY | BASIS WEIGHT ($g/m^2$) | UPPER LIMIT |
|---|---|---|
| ・ | ・ | ・ |
| ・ | ・ | ・ |
| PLAIN PAPER | 81～100 | 1200V |
| THICK PAPER 1 | 101～125 | 1350V |
| THICK PAPER 2 | 126～150 | 1500V |
| | ・ | ・ |
| | ・ | ・ |

Fig. 16

| | | PAPER WIDTH (mm) | | | | |
|---|---|---|---|---|---|---|
| | | 0 | 105 | 148.5 | 210 | 297 |
| BASIS WEIGHT ($g/m^2$) | 52 | 100% | 100% | 100% | 100% | 100% |
| | 100 | 100% | 99% | 98% | 97% | 96% |
| | 200 | 100% | 98% | 95% | 94% | 93% |
| | 250 | 100% | 95% | 90% | 89% | 88% |
| | 300 | 100% | 92% | 87% | 86% | 85% |
| | 350 | 100% | 90% | 85% | 83% | 80% |

| | | PAPER WIDTH (mm) | | | | |
|---|---|---|---|---|---|---|
| | | 0 | 105 | 148.5 | 210 | 297 |
| BASIS WEIGHT ($g/m^2$) | 52 | 100% | 100% | 100% | 100% | 100% |
| | 199 | 100% | 100% | 100% | 100% | 100% |
| | 200 | 100% | 98% | 95% | 94% | 93% |
| | 250 | 100% | 95% | 90% | 89% | 88% |
| | 300 | 100% | 92% | 87% | 86% | 85% |
| | 350 | 100% | 90% | 85% | 83% | 80% |

Fig. 20

IMAGE FORMING APPARATUS

TECHNICAL FIELD

The present invention relates to an image forming apparatus, such as a copying machine, a printer or a facsimile machine, of an electrophotographic type or an electrostatic recording type.

BACKGROUND ART

Conventionally, in the image forming apparatus of the electrophotographic type or the like, a toner image is electrostatically transferred from a photosensitive member or an intermediary transfer belt as an image bearing member onto a recording material such as paper. This transfer is carried out in many cases by applying a transfer voltage to a transfer member such as a transfer roller for forming a transfer portion in contact with the image bearing member. When the transfer voltage is excessively low, a "poor image density" such that the transfer is not sufficiently carried out and a desired image density cannot be obtained occurs in some instances. Further, when the transfer voltage is excessively high, electric discharge occurs at a transfer portion and a polarity of electric charges of toner of the toner image is reversed by the influence of the electric discharge, so that a "white void" such that the toner image is not partly transferred occurs in some instances. For that reason, in order to form a high-quality image, it is required that a proper transfer voltage is applied to the transfer member.

In Japanese Laid-Open Patent Application (JP-A) 2004-117920, the following control of a transfer voltage in a constitution in which the transfer voltage is applied to the transfer member under constant-voltage control has been disclosed. A predetermined voltage is applied to the transfer portion where the recording material is absent immediately before a start of continuous image formation and a current value is detected, so that a voltage value at which a predetermined target current is obtained is acquired. Then, a recording material part (sharing) voltage depending on the kind of the recording material is added to this voltage value, and a transfer voltage value applied in the constant voltage control during the transfer is set. By such control, it is possible to apply the transfer voltage depending on a desired (predetermined) target current through the constant-voltage control irrespective of a fluctuation in electric resistance value of the transfer portion such as the transfer member and a fluctuation in electric resistance value of the recording material.

Here, the kind of the recording material includes a kind depending on a difference in surface smoothness of the recording material such as high-quality paper or coated paper and a kind depending on a difference in thickness of the recording material such as thin paper or thick paper, for example. The recording material part voltage can be acquired in advance depending on such a kind of the recording material, for example. However, the kinds of recording materials put in circulation are very large, or the electric resistance of the recording material fluctuates depending on a time or the like in which the recording material is placed in an environment even when the environment (temperature, humidity) is the same, so that it is difficult to acquire the recording material part voltage in advance with accuracy in many instances. When the transfer voltage inclusive of an amount corresponding to the fluctuation in electric resistance of the recording material is not a proper value, as described above, an image defect such as the poor image density or the white void occurs in some instances.

In order to solve such a problem, in Japanese Patent 4161005 and JP-A 2008-275946, in the constitution in which the transfer voltage is applied to the transfer member under the constant-voltage control when the recording material passes through the transfer portion, it has been proposed that an upper limit and a lower limit of a current supplied to the transfer portion are provided. By such control, the current supplied to the transfer portion when the sheet recording material passes through the transfer portion can be made a value within a predetermined range, and therefore, it is possible to suppress generation of the image defect due to excess and deficiency of the transfer current. In Japanese Patent 4161005, the upper limit is acquired on the basis of environment information. In JP-A 2008-275946, the upper limit and the lower limit are acquired depending on front/back of the recording material, the kind of the recording material and the size of the recording material in addition to the environmental information.

SUMMARY OF THE INVENTION

Problem to be Solved by the Invention

However, as the current flowing through the transfer portion when the recording material passes through the transfer portion, a "sheet (paper) passing portion current (passing portion current)" and a "non-sheet (paper) passing portion current (non-passing portion current)" exist. The sheet passing portion current is a current flowing through a region ("sheet passing portion (passing region)" of the transfer portion where the recording material passes in the direction substantially perpendicular to a recording material feeding direction. Further, the non-sheet passing portion current is a current flowing through a region "non-sheet passing portion (non-passing portion)" of the transfer portion where the recording material does not pass in the direction substantially perpendicular to the recording material feeding direction. The reason why the non-sheet passing portion current generates is that the transfer member such as a transfer roller is made larger in length in a longitudinal direction thereof than a maximum width of the recording material in the image forming apparatus in order to stably feed toner images to recording materials of various sizes and to transfer the toner images onto the recording materials.

A detectable current when the recording material passes through the transfer portion is the sum of the sheet passing portion current and the non-sheet passing portion current. In order to suppress the image defect as described above, it is important that the sheet passing portion current is a value of a proper range, but detection of only the sheet passing portion current cannot be made. Moreover, an electric resistance of the transfer member forming the non-sheet passing portion fluctuates under various conditions. As the various conditions, it is possible to cite a variation of a product, an environment (temperature, humidity), a temperature and hygroscopic degree of a member, a cumulative use time (an operation status and a repetitive use amount status of the image forming apparatus) and the like. For that reason, even when an upper limit and a lower limit ("transfer current range") of the transfer current is acquired for each of sizes of recording materials in advance, a proper transfer current range changes depending on a fluctuation in electric resistance of the transfer member. Methods described in Japanese Patent 4161005 and JP-A 2008-275946 do not meet the fluctuation in electric resistance of the transfer member forming this non-sheet passing portion.

Accordingly, an object of the present invention is to provide an image forming apparatus capable of setting an allowable range of a current flowing through a transfer member depending on a fluctuation in electric resistance of the transfer member.

Means for Solving the Problems

According to the present invention, there is provided an image forming apparatus comprising: an image bearing member for bearing a toner image; an intermediary transfer belt onto which the toner image is transferred from the image bearing member; a transfer member, to which a voltage is applied, for transferring the toner image from the intermediary transfer belt onto a recording material in a transfer portion; a voltage source for applying the voltage to the transfer member; a current detecting portion for detecting a current flowing though the transfer member; and a controller for carrying out constant-voltage control so that the voltage applied to the transfer member is a predetermined voltage at the time of transfer when the toner image is transferred onto the recording material, wherein at the time of transfer when the toner image is transferred onto the recording material, on the basis of a detection result of the current detecting portion, the controller controls the voltage applied to the transfer member so that the current flowing through the transfer member falls within a predetermined range, and wherein the controller sets an upper limit and a lower limit of the predetermined range on the basis of a current flowing through the transfer member when the voltage is applied to the transfer member or a voltage applied to the transfer member when a current is supplied to the transfer member, in a state in which the recording material is absent in said transfer portion.

Further, according to the present invention, there is provided an image forming apparatus comprising: an image bearing member for bearing a toner image; an intermediary transfer belt onto which the toner image is transferred from the image bearing member; a transfer member, to which a voltage is applied, for transferring the toner image from the intermediary transfer belt onto a recording material in a transfer portion; a voltage source for applying the voltage to the transfer member; a current detecting portion for detecting a current flowing though the transfer member; and a controller for carrying out constant-voltage control so that the voltage applied to the transfer member is a predetermined voltage at the time of transfer when the toner image is transferred onto the recording material, wherein the controller corrects a detection result detected by the current detecting portion on the basis of a current flowing through the transfer member when the voltage is applied to the transfer member or a voltage applied to the transfer member when a current is supplied to the transfer member, and controls the voltage applied to the transfer member so that the corrected value falls within a predetermined range, in a state in which the recording material is absent in said transfer portion.

Effect of the Invention

According to the present invention, depending on the fluctuation in electric resistance of the transfer member, it is possible to set the allowable range of the current flowing through the transfer member.

BRIEF DESCRIPTION OF THE DRAWINGS

FIG. 11 includes tables for illustrating a problem.

FIG. 12 is a table for illustrating a problem in an embodiment 3.

FIG. 16 is a schematic view showing an example of an upper limit table data of the recording material part voltage.

FIG. 20 is a schematic view showing another example of the table data of correction coefficient of the non-sheet passing portion current.

EMBODIMENTS FOR CARRYING OUT THE INVENTION

In the following, an image forming apparatus according to the present invention will be specifically described in accordance with the drawings.

Embodiment 1

1. General Constitution and Operation of Image Forming Apparatus

Figure 1:
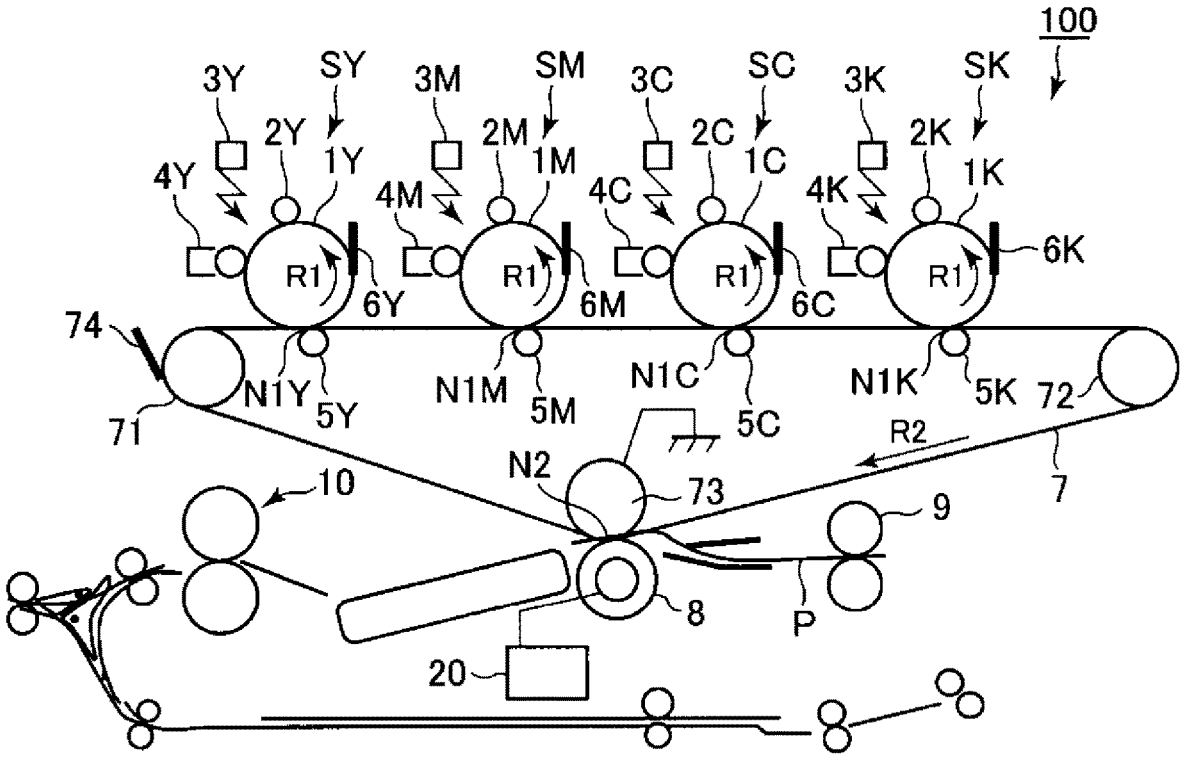
FIG. 1 is a schematic sectional view of an image forming apparatus.

FIG. 1 is a schematic sectional view of an image forming apparatus 100 of the present invention. The image forming apparatus 100 in this embodiment is a tandem multi-function machine (having functions of a copying machine, a printer and a facsimile machine) which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K). As regards elements of the respective image forming portions SY, SM, SC and SK having the same or corresponding functions or constitutions, suffixes Y, M, C and K for representing the elements for associated colors are omitted, and the elements will be collectively described in some instances. The image forming portion S is constituted by including a photosensitive drum 1, a charging roller 2, an exposure device 3, a developing device 4, a primary transfer roller 5, and a drum cleaning device 6 which are described later.

The image forming portion S includes the photosensitive drum 1 which is a rotatable drum-shaped (cylindrical) photosensitive member (electrophotographic photosensitive member) as a first image bearing member for bearing a toner image. The photosensitive drum 1 is rotationally driven in an arrow R1 direction (counterclockwise direction) in FIG. 1. A surface of the rotating photosensitive drum 1 is electrically charged uniformly to a predetermined polarity (negative in this embodiment) and a predetermined potential by the charging roller 2 which is a roller-type charging member as a charging means. The charged photosensitive drum 1 is subjected to scanning exposure to light by the exposure device (laser scanner device) 3 as an exposure means on the basis of image information, so that an electrostatic image (electrostatic latent image) is formed on the photosensitive drum 1.

The electrostatic image formed on the photosensitive drum 1 is developed (visualized) by supplying toner as a developer by the developing device 4 as a developing means, so that a toner image is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development type). In this embodiment, a normal charge polarity of the toner which is the charge polarity of the toner during development is a negative polarity. The electrostatic image formed by the exposure device 3 is an aggregate of small dot images, and a density of the toner image to be formed on the photosensitive drum 1 can be changed by changing a density of the dot images. In this embodiment, the toner image of each of the respective colors has a maximum density of about 1.5-1.7, and a toner application amount per unit area at the maximum density is about 0.4-0.6 mg/cm$^2$.

As a second image bearing member for bearing the toner image, an intermediary transfer belt 7 which is an intermediary transfer member constituted by an endless belt is provided so as to be contactable to the surfaces of the four photosensitive drums 1. The intermediary transfer belt 7 is stretched by a plurality of stretching rollers including a driving roller 71, a tension roller 72, and a secondary transfer opposite roller 73. The driving roller 71 transmits a driving force to the intermediary transfer belt 7. The tension roller 72 controls tension of the intermediary transfer belt 7 at a constant value. The secondary transfer opposite roller 73 functions as an opposing member (opposing electrode) to a secondary transfer roller 8 (described later). The intermediary transfer belt 7 is rotated (circulated or moved) at a feeding speed (peripheral speed) of about 300-500 mm/sec in an arrow R2 direction (clockwise direction) in FIG. 1 by rotational drive of the driving roller 71. To the tension roller 72, a force such that the intermediary transfer belt 7 is pushed out from an inner peripheral surface side toward an outer peripheral surface side is applied by a force of a spring as an urging means, so that by this force, tension of about 2-5 kg is exerted on the intermediary transfer belt 7 with respect to a feeding direction of the intermediary transfer belt 7. On the inner peripheral surface side of the intermediary transfer belt 7, the primary transfer rollers 5 which are roller-type primary transfer members as primary transfer means are disposed correspondingly to the respective photosensitive drums 1. The primary transfer roller 5 is urged (pressed) toward an associated photosensitive drum 1 through the intermediary transfer belt 7, whereby a primary transfer portion (primary transfer nip) N1 where the photosensitive drum 1 and the intermediary transfer belt 7 contact each other is formed. The toner image formed on the photosensitive drum 1 is electrostatically transferred primary-transferred by the action of the primary transfer roller 5 onto the rotating intermediary transfer belt 7 at the primary transfer portion T1. During the primary transfer step, to the primary transfer roller 5, a primary transfer voltage (primary transfer bias) which is a DC voltage of an opposite polarity to a normal charge polarity of the toner is applied from an unshown primary transfer voltage source. For example, during full-color image formation, the color toner images of Y, M, C and K formed on the respective photosensitive drums 1 are successively (primary)-transferred superposedly onto the intermediary transfer belt 7.

On an outer peripheral surface side of the intermediary transfer belt 7, at a position opposing the secondary transfer opposite roller 73, the secondary transfer roller 8 which is a roller-type secondary transfer member as a secondary transfer means is provided. The secondary transfer roller 8 is urged toward the secondary transfer roller 73 through the intermediary transfer belt 7 and forms a secondary transfer portion (secondary transfer nip) N where the intermediary transfer belt 7 and the secondary transfer roller 8 contact each other. The toner images formed on the intermediary transfer belt 7 are electrostatically transferred (secondary-transferred) onto a recording material (sheet, transfer(-receiving) material) P such as paper (sheet) sandwiched and fed by the intermediary transfer belt 7 and the secondary transfer roller 8 at the secondary transfer portion N2 by the action of the secondary transfer roller 8. During the secondary transfer step, to the secondary transfer roller 8, a secondary transfer voltage (secondary transfer bias) which is a DC voltage of the opposite polarity to the normal charge polarity of the toner is applied from a secondary transfer voltage source (high voltage source circuit) 20. The recording material P is accommodated in a recording material cassette (not shown) or the like, and is fed one by one from the recording material cassette by a feeding roller (not shown) or the like, and then is fed to a registration roller 9. This recording material P is fed toward the secondary transfer portion N2 by being timed to the toner images on the intermediary transfer belt 7 after being once stopped by the registration roller 9.

The recording material P on which the toner images are transferred is fed toward a fixing device 10 as a fixing means by a feeding member or the like. The fixing device 10 heats and presses the recording material P carrying thereon unfixed toner images, and thus fixes (melts) the toner images on the recording material P. Thereafter, the recording material P is discharged (outputted) to an outside of an apparatus main assembly of the image forming apparatus 100.

Further, toner (primary transfer residual toner) remaining on the surface of the photosensitive drum 1 after the primary transfer step is removed and collected from the surface of the photosensitive drum 1 by the drum cleaning device 6 as a photosensitive member cleaning means. Further, deposited matters such as toner (secondary transfer residual toner) remaining on the surface of the intermediary transfer belt 7 after the secondary transfer step, and paper powder are removed and collected from the surface of the intermediary transfer belt 7 by a belt cleaning device 74 as an intermediary transfer member cleaning means.

Here, in this embodiment, the intermediary transfer belt 7 is an endless belt having a three-layer structure of a resin layer, an elastic layer and a surface layer from an inner peripheral surface side to an outer peripheral surface side thereof. As a resin material constituting the resin layer, polyimide, polycarbonate or the like can be used. As a thickness of the resin layer, 70-100 μm is suitable. Further, as an elastic material constituting the elastic layer, urethane rubber, chloroprene rubber or the like can be used. As a thickness of the elastic layer, 200-250 μm is suitable. As a material of the surface layer, a material for permitting easy transfer of the toner (image) onto the recording material P at the secondary transfer portion N2 by decreasing a depositing force of the toner onto the surface of the intermediary transfer belt 7 may desirably be used. For example, it is possible to use one or two or more kinds of resin materials such as polyurethane, polyester, epoxy resin and the like. Or, it is possible to use one or two or more kinds of elastic materials such as an elastic material rubber, an elastomer, a butyl rubber and the like. Further, it is possible to use one or two or more kinds of materials of powder or particles such as a material for enhancing a lubricating property by reducing surface energy in a dispersion state in the elastic material, or one or two or more kinds of the powder or the particles which are different in particle size and which are dispersed in the elastic material. Incidentally, a thickness of the surface layer may suitably be 5-10 μm. As regards the intermediary transfer belt 7, an electric resistance is adjusted by adding an electroconductive agent for electric resistance adjustment such as carbon black into the intermediary transfer belt 7, so that volume resistivity of the intermediary transfer belt 7 may preferably be $1\times10^{9}$-$1\times10^{14}$ Ω·cm.

Further, in this embodiment, the secondary transfer roller 8 is constituted by including a core metal (base material) and an elastic layer formed with an ion-conductive foam rubber (NBR) around the core metal. In this embodiment, the secondary transfer roller 8 is 24 mm in outer diameter and 6.0-12.0 μm in surface roughness Rz. Further, in this embodiment, the electric resistance of the secondary transfer roller 8 is $1\times10^{5}$-$1\times10^{7}$Ω as measured under application of a voltage of 2 kV in an N/N (23° C./50% RH) environment. Hardness of the elastic layer is about 30-40° in terms of Asker-C hardness. Further, in this embodiment, a dimension (width) of the secondary transfer roller 8 with respect to a longitudinal direction (widthwise direction) (i.e., a length of the secondary transfer roller 8 with respect to a direction substantially perpendicular to the recording material feeding direction) is about 310-340 mm. In this embodiment, the dimension of the secondary transfer roller 8 with respect to the longitudinal direction is longer than a maximum dimension (maximum width) of widths (lengths with respect to the direction substantially perpendicular to the recording material feeding direction) of the recording materials for which feeding is ensured by the image forming apparatus 100. In this embodiment, the recording material P is fed on the basis of a center (line) of the secondary transfer roller 8 with respect to the longitudinal direction, and therefore, all the recording materials P for which feeding is ensured by the image forming apparatus 100 pass through within a length range of the secondary transfer roller 8 with respect to the longitudinal direction. As a result, it is possible to stably feed the recording materials P having various sizes and to stably transfer the toner images onto the recording materials P having the various sizes.

Figure 2:
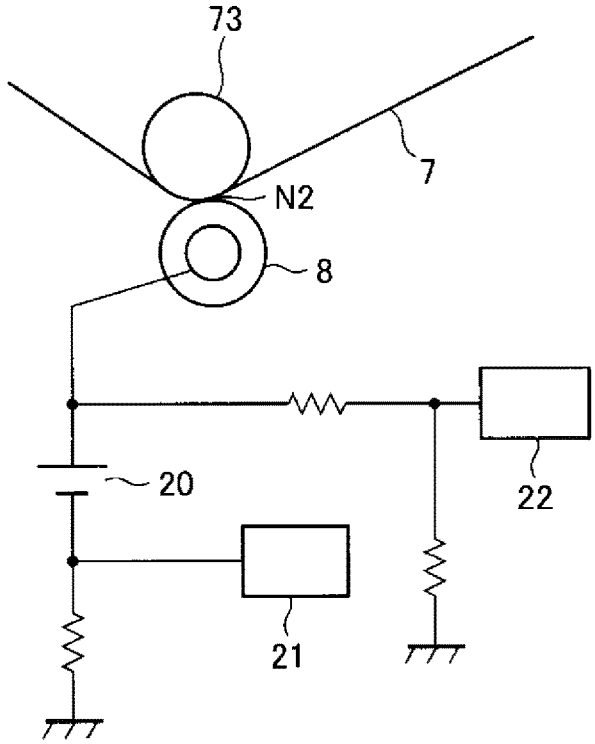
FIG. 2 is a schematic view of a constitution relating to secondary transfer.

FIG. 2 is a schematic view of a constitution regarding the secondary transfer. The secondary transfer roller 8 contacts the intermediary transfer belt 7 toward the secondary transfer opposite roller 73 and thus forms the secondary transfer portion N2. To the secondary transfer roller 8, a secondary transfer voltage source 20 with a variable output current voltage value is connected. The secondary transfer opposite roller 73 is electrically grounded (connected to the ground). When the recording material P passes through the secondary transfer portion N2, to the secondary transfer roller 8, a secondary transfer voltage which is a DC voltage of the opposite polarity to the normal charge polarity of the toner is applied, so that a secondary transfer current is supplied to the secondary transfer portion N2, and thus the toner image is transferred from the intermediary transfer belt 7 onto the recording material P. In this embodiment, during the secondary transfer, for example, the secondary transfer current of +20 to +80 μA is caused to flow through the secondary transfer portion N2. Incidentally, a constitution in which the secondary transfer roller 8 is electrically grounded and in which the secondary transfer voltage is applied to the secondary transfer opposite roller 73 may also be employed.

Figure 3:
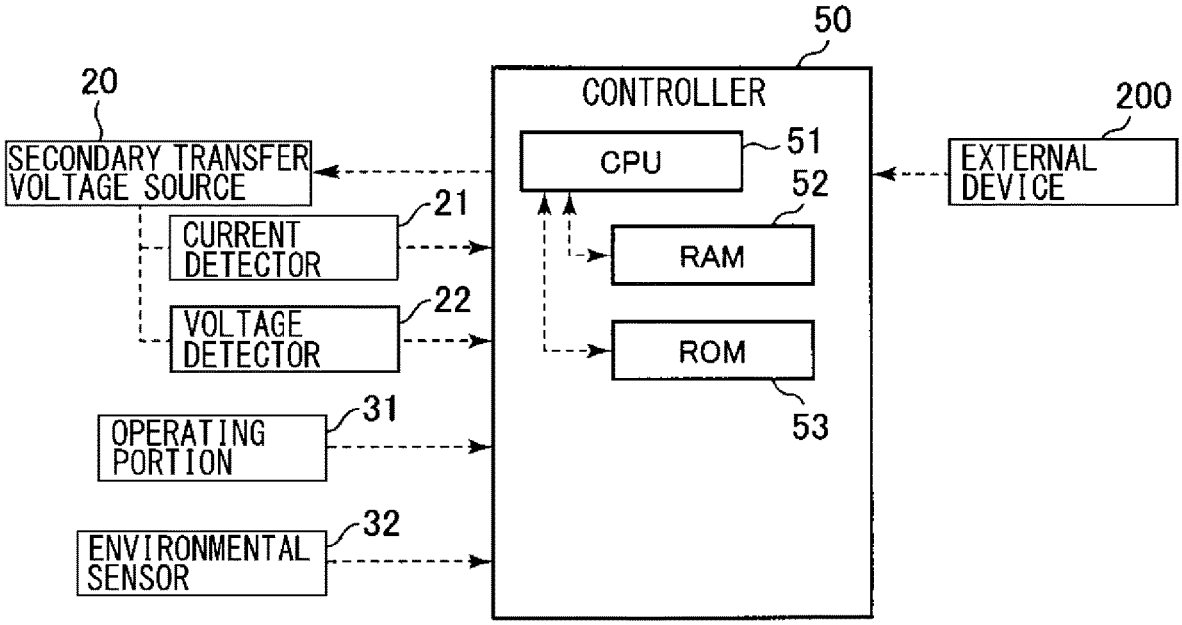
FIG. 3 is a schematic block diagram showing a control mode of a principal part of the image forming apparatus.

In this embodiment, on the basis of various pieces of information, an upper limit and a lower limit ("secondary transfer current range") of the secondary transfer current when the recording material P passes through the secondary transfer portion N2 is determined. As described later specifically, the various pieces of information include the following pieces of information. First, the information is information on a condition designated by an operating portion 31 (FIG. 3) provided in the main assembly of the image forming apparatus 100 or by an external device 200 (FIG. 3) such as a personal computer communicatably connected to the image forming apparatus 100. Further, the information is information on a detection result of an environmental sensor 32 (FIG. 3). Further, the information is information on the electric resistance of the secondary transfer portion N2 detected before the recording material P reaches the secondary transfer portion N2. Then, when the recording material P passes through the secondary transfer portion N2, the secondary transfer voltage outputted from the secondary transfer voltage source 20 under constant-voltage control is controlled so that the secondary transfer current becomes a value of the above-described secondary transfer current range, while detecting the secondary transfer current flowing through the secondary transfer portion N2. In this embodiment, in order to carry out such control, to the secondary transfer voltage source 20, a current detecting circuit 21 as a current detecting means (detecting portion) for detecting a current (secondary transfer current) flowing through the secondary transfer portion N2 (i.e., the secondary transfer voltage source 20) is connected. Further, to the secondary transfer voltage source 20, a voltage detecting circuit 22 as a voltage detecting means (detecting portion) for detecting a voltage (transfer voltage) outputted from the secondary transfer voltage source 20 is connected. In this embodiment, the secondary transfer voltage source 20, the current detecting circuit 21 and the voltage detecting circuit 22 are provided in the same high-voltage substrate.

2. Control Mode

FIG. 3 is a schematic block diagram showing a control mode of a principal part of the image forming apparatus 100 in this embodiment. A controller (control circuit) 50 is constituted by including a CPU 51 as a control means which is a dominant element for performing processing, and memories (storing media) such as a RAM 52 and a ROM 53 which are used as storing means. In the RAM 52 which is rewritable memory, information inputted to the controller 50, detected information, a calculation result and the like are stored. In the ROM 53, a data table acquired in advance and the like are stored. The CPU 51 and the memories such as the RAM 52 and the ROM 53 are capable of transferring and reading the data therebetween.

To the controller 50, an image reading device (not shown) provided to the image forming apparatus and the external device 200 such as a personal computer are connected. Further, to the controller 50, the operating portion (operating panel) 31 provided in the image forming apparatus 100 is connected. The operating portion 31 is constituted by including a display portion for displaying various pieces of information to an operator such as a user or a service person by control from the controller 50 and including an input portion for inputting various settings on the image formation and the like by the operator. Further, to the controller 50, the secondary transfer voltage source 20, the current detecting circuit 21 and the voltage detecting circuit 22 are connected. In this embodiment, on the basis of a detection result of the voltage detecting circuit 22, the secondary transfer voltage source 20 applies, to the secondary transfer roller 8, the secondary transfer voltage which is the DC voltage subjected to the constant-voltage control. Further, to the controller 50, the environmental sensor 32 is connected. The environmental sensor 32 detects a temperature and a humidity in a casing of the image forming apparatus 100. Information on the temperature and the humidity which are detected by the environmental sensor 32 are inputted to the controller 50. The environmental sensor 32 is an example of an environment detecting means for detecting at least one of the temperature and the humidity of at least one of an inside and an outside of the image forming apparatus 100. On the basis of image information from the image reading device or the external device 200 and a control instruction from the operating portion 31 or the external device 200, the controller 50 carries out integrated control of respective portions of the image forming apparatus 100 and causes the image forming apparatus 100 to execute an image forming operation.

Here, the image forming apparatus 100 executes a job (printing operation) which is a series of operations started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image, primary transfer of the toner image and secondary transfer of the toner image are carried out, in general, and "during image formation (image forming period)" refers to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. "During non-image formation (non-image formation period)" is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. In this embodiment, during the non-image formation, control of determining the upper limit and the lower limit (secondary transfer current range) of the secondary transfer current is carried out.

Figures 9, 10:
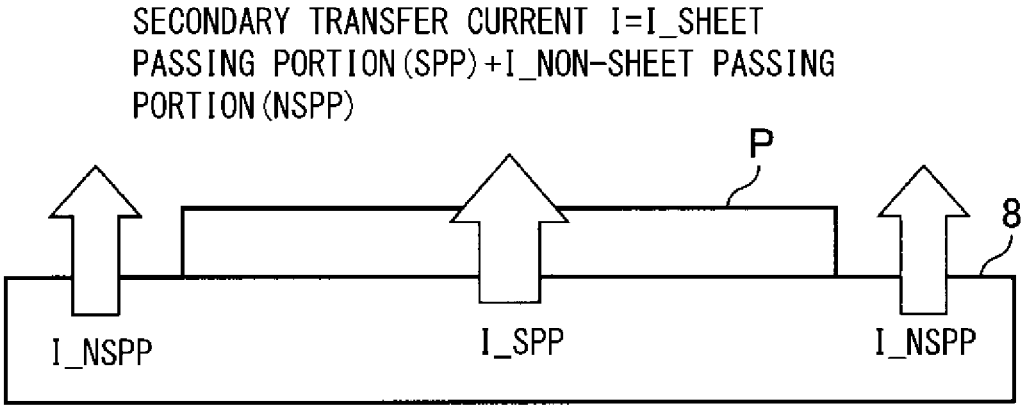
FIG. 9 is a schematic view showing an example of table data of a secondary transfer current target value.
FIG. 10 is a schematic view for illustrating a sheet passing portion current and a non-sheet passing portion current.

3. Change in Proper Secondary Transfer Current Range Due to Fluctuation of Non-Sheet Passing Portion Current Here, the above-described problem will be described further specifically. As shown in FIG. 10, as a current flowing through the secondary transfer portion N2 when the recording material P passes through the secondary transfer portion N2, a sheet passing portion current (I_SPP) and a non-sheet passing portion (I_NSPP) exist. A current detectable when the recording material P passes through the secondary transfer portion N2 is the sum of the sheet passing portion current and the non-sheet passing portion current. In order to suppress an image defect such as white void, it is important that the sheet passing portion current is a proper range value, but it is unable to detect only the sheet passing portion current. Therefore, it would be considered that a secondary transfer current during passing of the recording material P through the secondary transfer portion N2 is controlled to a value within a secondary transfer current range thereof depending on a size of the recording material P by acquiring an upper limit and a lower limit ("secondary transfer current range") of a proper secondary transfer current for each of sizes of recording materials P in advance. However, even when the proper secondary transfer current range is determined in advance, an electric resistance of the secondary transfer roller 8 forming the non-sheet passing portion fluctuates depending on various conditions. As such various conditions, it is possible to cite a variation of a product, an environment (temperature, humidity, a temperature and a hygroscopic degree of a member), a cumulative use time (an operation status and a repetitive use amount status of the image forming apparatus) and the like. For that reason, the proper secondary transfer current range changes depending on a fluctuation in electric resistance of the secondary transfer roller 8.

This will be further described with reference to FIG. 11. Part (a) of FIG. 11 shows the secondary transfer current range for each of sizes of recording materials P determined by an experiment or the like in advance. In order to sufficiently suppress the image defect, a range of a current which may be caused to flow through the sheet passing portion when the recording material P passes through the secondary transfer portion N2 was 15-20 μA when the recording material P (paper) with a width (297 mm) corresponding to an A4 size was used. Further, when the recording material P (paper) with a width (148.5 mm) corresponding to an A5R size was used, the range of the current was decreased correspondingly to the width shorter than the width of the A4 size and was 7.5-10 μA. A width of the secondary transfer roller 8 with respect to a longitudinal direction in the image forming apparatus for which the range of this secondary transfer current was determined was 338 mm. Further, a range of a current flowed through the non-sheet passing portion when the recording material P passes through the secondary transfer portion N2 was 3.6-4.4 μA when the size of the recording material P was the A4 size, and was 16.6-20.3 μA when the size of the recording material P was the A5R size. Accordingly, the range ("secondary transfer current range") of the current which may be caused to flow through the secondary transfer portion N2 when the recording material P passes through the secondary transfer portion N2 is 18.6-24.4 μA when the recording material size was the A4 size, and was 24.1-30.3 μA when the recording material size was the A5R size.

However, for example, in the case where the electric resistance of the secondary transfer portion (principally the secondary transfer roller 8 in this embodiment) becomes low, the current flowing through the non-sheet passing portion increases. Part (b) of FIG. 11 shows an example of a proper secondary transfer current range in the case where the electric resistance of the secondary transfer portion N2 becomes lower than the electric resistance in a state when the secondary transfer current range shown in part (a) of FIG. 11 is determined. Even when the electric resistance of the secondary transfer portion N2 becomes low, the range of the current which may be caused to flow through the sheet passing portion is unchanged. However, when the electric resistance of the secondary transfer portion N2 becomes low, the secondary transfer current which is the sum of the sheet passing portion current and the non-sheet passing portion current is shifted in each of the upper limit and the lower limit thereof to a higher side due to an increase in non-sheet passing portion current. For example, the case where the secondary transfer current when the recording material P with the A5R size passes through the secondary transfer portion N2 is 24.5 μA will be considered. In this case, when the electric resistance of the secondary transfer roller 8 is the same as the electric resistance in a state when the secondary transfer current range is as shown in part (a) of FIG. 11, the secondary transfer current is the value falling within the proper secondary transfer current range, and therefore, a proper current flows through the sheet passing portion. However, in the case where the electric resistance of the secondary transfer roller 8 becomes lower to the same extent as the electric resistance in a state shown in part (b) of FIG. 11 in which the secondary transfer current range is proper, when the secondary transfer current is still 24.5 μA, the secondary transfer current is lower than the lower limit (26.9 μA) of the proper secondary transfer current range. For that reason, the current flowing through the sheet passing portion is insufficient, so that the image defect occurs in some instances.

That is, in the case of the secondary transfer current value in the neighborhood of the lower limit in the case where the electric resistance of the non-sheet passing portion is a certain value, even when there is no problem in a state of the electric resistance of the non-sheet passing portion, in a state in which the electric resistance of the non-sheet passing portion becomes low, the current of the sheet passing portion deviates from the lower limit at which the image defect can be suppressed. On the other hand, in the case where the electric resistance of the secondary transfer portion N2 becomes high, the current flowing through the non-sheet passing portion decreases. In this case, each of the upper limit and the lower limit of the secondary transfer current shifts to a lower side. For that reason, in the case of the secondary transfer current value in the neighborhood of the upper limit in the case where the electric resistance of the non-sheet passing portion is a certain value, even when there is no problem in a state of the electric resistance of the non-sheet passing portion, in a state in which the electric resistance of the non-sheet passing portion becomes high, the current of the sheet passing portion deviates from the upper limit at which the image defect can be suppressed.

4. Secondary Transfer Voltage Control

Figure 4:
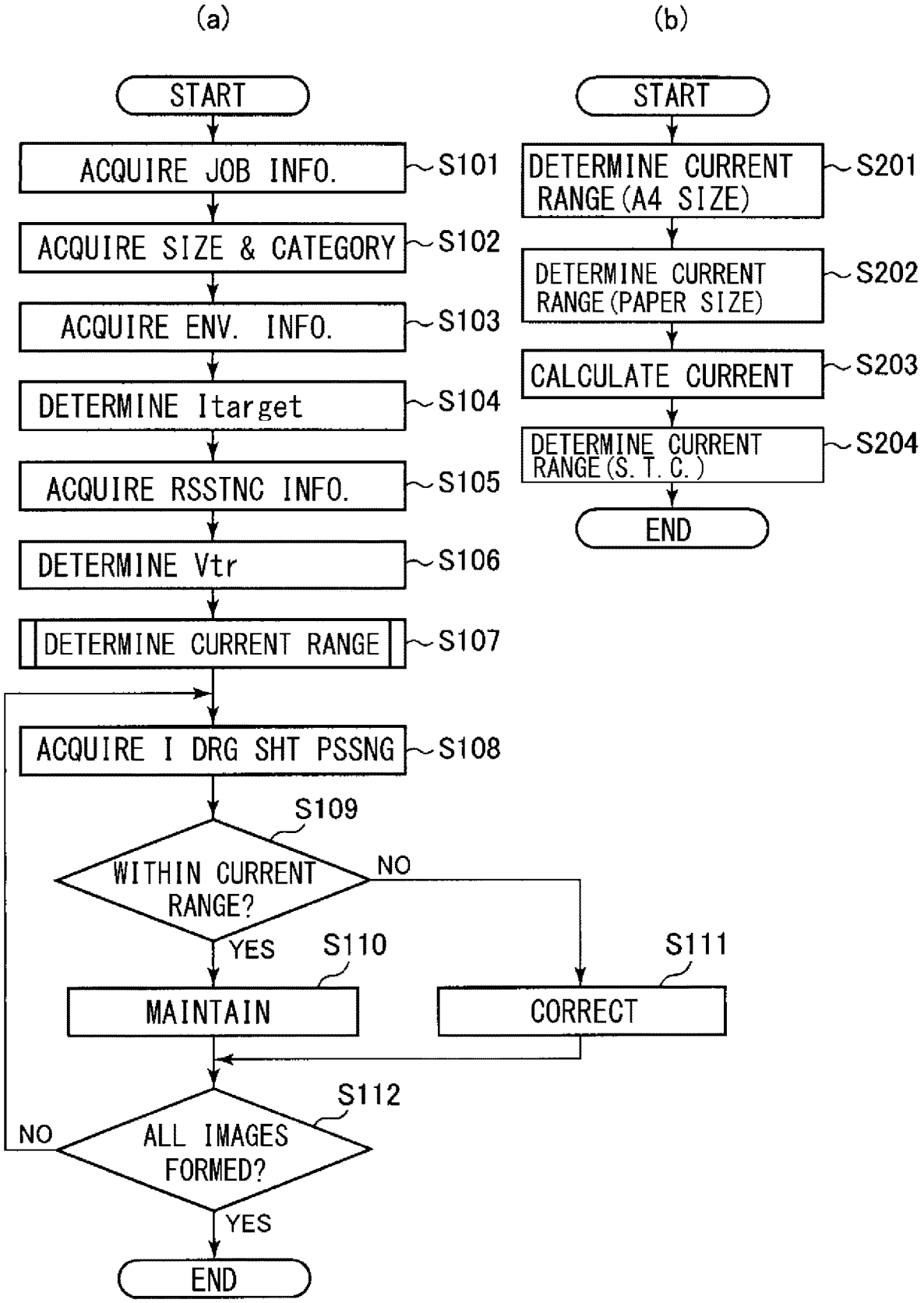
FIG. 4 includes flowcharts of control in an embodiment 1.

Next, secondary transfer voltage control in this embodiment will be described. FIG. 4 includes flowcharts showing an outline of a procedure of the secondary transfer voltage control in this embodiment. In FIG. 4, of steps of control executed by the controller 50 when a job is executed, a procedure relating to the secondary transfer voltage control is shown in a simplified manner, and other many steps of control during the execution of the job are omitted from illustration.

With reference to part (a) of FIG. 4, first, when the controller 50 acquires information of the job from the operating portion 31 or the external device 200, the controller 50 causes the image forming apparatus to start the job (S101). In this embodiment, in information on this job, image information designated by the operator, information on a size (width, length) of the recording material P on which the image is formed, information (thickness, basis weight) relating to a thickness of the recording material P, and information relating to a surface property of the recording material P such as whether or not the recording material P is coated paper are included. That is, pieces of information on the paper size (width, length) and on a paper kind category (plain paper, thick paper and the like (including information relating to the thickness)) are included. The controller 50 writes this information on the job in the RAM 52 (S102).

Then, the controller 50 acquires environmental information detected by the environmental sensor 32 (S103). Further, in the ROM 53, information indicating a correlation between the environmental information and the target current Itarget for transferring the toner image on the intermediary transfer belt 7 onto the recording material P is stored. On the basis of the environmental information read in S103, the controller 50 acquires a target current Itarget corresponding to an environment from information indicating a relationship between the above-described environmental information and the target current Itarget, and writes this in the RAM 52 (S104).

Incidentally, the reason why the target current Itarget is changed depending on the environmental information is that a charge amount of the toner changes depends on the environment. The information indicating the relationship between the above-described environmental information and the target current Itarget is acquired by an experiment or the like in advance. Here, the charge amount of the toner is influenced by, in addition to the environment, timing when the toner is supplied to the developing device, and a use history such as an amount of the toner coming out of the developing device 4 in some instances. In order to suppress these influences, the information 100 is constituted so that the charge amount of the toner in the developing device 4 is a value within a certain range. However, in addition to the environmental information, when a factor affecting the charge amount of the toner on the intermediary transfer belt 7 is known, the target current Itarget may also be changed depending on information thereon. Further, a measuring means for measuring the charge amount of the toner is provided in the image forming apparatus 100, and on the basis of information on the toner charge amount acquired by this measuring means, the target current Itarget may also be changed.

Figures 5, 6, 7:
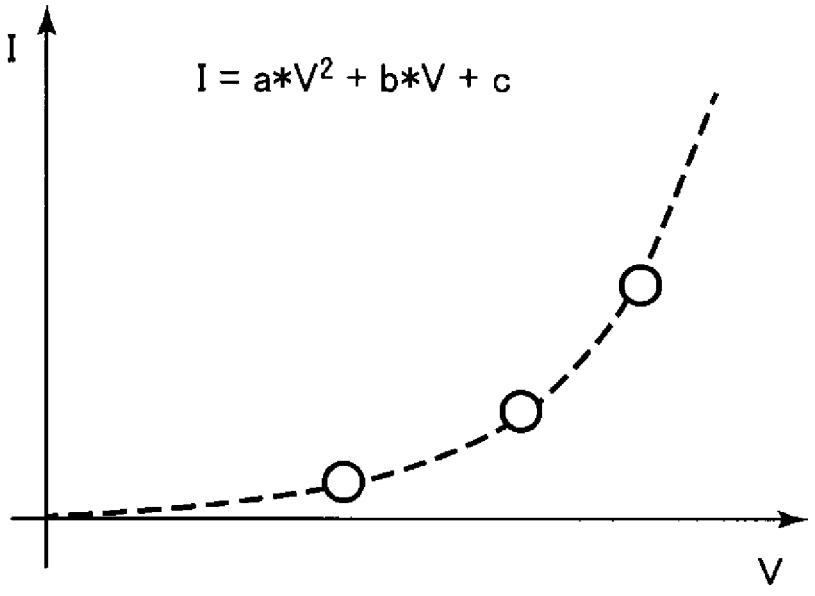
FIG. 5 is a graph showing an example of a relationship between a voltage and a current at a secondary transfer portion.
FIG. 6 is a table showing an example of table data of a recording material part (sharing) voltage.
FIG. 7 is a table showing an example of table data of a predetermined current range.

Next, the controller 50 acquires information on the electric resistance of the secondary transfer portion N2 before the toner image on the intermediary transfer belt and the recording material P on which the toner image is to be transferred reach the secondary transfer portion N2 (S105). In this embodiment, the information on the electric resistance of the secondary transfer portion N2 (principally the secondary transfer roller 8 in this embodiment) is acquired by the following ATVC (active transfer voltage control). That is, in a state in which the secondary transfer roller 8 and the intermediary transfer belt 7 are brought into contact with each other, a predetermined voltage or a predetermined current is applied from the secondary transfer voltage source 20 to the secondary transfer roller 8. Further, a current value when the predetermined voltage is supplied or a voltage value when the predetermined current is supplied is detected, so that a relationship between the voltage and the current (voltage-current characteristic) is acquired. This relationship between the voltage and the current changes depending on the electric resistance of the secondary transfer portion N2 (principally the secondary transfer roller 8 in this embodiment). In the constitution of this embodiment, as regards the above-described relationship between the voltage and the current, the current is not linearly changed (proportional) relative to the voltage, but as shown in FIG. 5, the current changes as represented by a polynomial expression of a quadratic or higher degree of the voltage. For that reason, in this embodiment, in order to represent the relationship between the voltage and the current by the polynomial expression, the predetermined voltage or the predetermined current supplied when the information on the electric resistance of the secondary transfer portion N2 is acquired were set at multiple levels of three or more.

Next, the controller 50 acquires a value of the voltage which should be applied from the secondary transfer voltage source 20 to the secondary transfer roller 8 (S106). That is, on the basis of the target current Itarget written in the RAM 52 in S104 and the relationship between the voltage and the current acquired in S105, the controller 50 acquires a voltage value Vb necessary to cause the target output Itarget to flow in a state in which the recording material P is absent in the secondary transfer portion N2. This voltage value Vb corresponds to a secondary transfer part (sharing) voltage. In the ROM 53, as shown in FIG. 6, information for acquiring a recording material part voltage Vp is stored. In this embodiment, this information is set as a table data showing a relationship between ambient water content and the recording material part voltage Vp for each of sections of a basis weight of the recording material P. Incidentally, the controller 50 can acquire the ambient water content on the basis of the environmental information (temperature, humidity) detected by the environmental sensor 32. The controller 50 acquires the recording material part voltage Vp from the table data on the basis of the information on the basis weight of the recording material P included in the information on the job acquired in S102 and the environmental information acquired in S103. Then, as an initial value of a secondary transfer voltage Vtr applied from the secondary transfer voltage source 20 to the secondary transfer roller 8 when the recording material P passes through the secondary transfer portion N2, the controller 50 acquires Vb+Vp which is the sum of the above-described Vb and Vp and writes this in the RAM 52. In this embodiment, the controller 50 acquires the initial value of the secondary transfer voltage Vtr until the recording material P reaches the secondary transfer portion N2 and prepares for timing when the recording material P reaches the secondary transfer portion N2.

The table data for acquiring the recording material part voltage Vp as shown in FIG. 6 has been acquired by an experiment or the like in advance. Here, the recording material part voltage (a transfer voltage corresponding to the electric resistance of the recording material P) Vp also changes by a surface property of the recording material P, in addition to the information (basis weight) relating to the thickness of the recording material P. For that reason, the table data may also be set so that the recording material part voltage Vp changes also depending on information relating to the surface property of the recording material P. Further, in this embodiment, the information relating to the thickness of the recording material P (and further the information relating to the surface property of the recording material P) are included in the information on the job acquired in S101. However, the image forming apparatus 100 may also be provided with a measuring means for detecting the thickness of the recording material P and the surface property of the recording material P, and on the basis of information acquired by this measuring means, the recording material part voltage Vp may also be acquired.

Then, the controller 50 carried out a process of determining the upper limit and the lower limit ("secondary transfer current range") when the recording material P passes through the secondary transfer portion N2 (S107). Part (b) of FIG. 4 shows a procedure of the process of determining the secondary transfer current range in S107 of part (a) of FIG. 4. In the ROM 53, as shown in FIG. 7, information for acquiring a range "(sheet passing portion current range (passing portion current range)" of a current which may be passed through the secondary transfer portion N2 when the recording material P passes through the secondary transfer portion N2, from the viewpoint of suppression of the image defect is stored. In this embodiment, this information is set as a table data showing a relationship between the ambient water content, and the upper limit and the lower limit of the current which may be passed through the sheet passing portion. Incidentally, this table data is acquired by an experiment or the like in advance. By making reference to part (b9 of FIG. 4, the controller 50 acquires a range of current which may be passed through the sheet passing portion from the table data on the basis of the above environmental information acquired in S103 (S201).

Incidentally, the range of the current which may be passed through the sheet passing portion changes depending on the width of the recording material P. In this embodiment, the above-described table data is set on the assumption that the recording material P is a recording material of 297 mm in width corresponding to an A4 size. Here, from the view point of suppressing the image defect the range of the current which may be passed through the sheet passing portion changes in some instances also depending on a thickness and a surface property of the recording material P as a factor other than the environmental information. For that reason, the table data may also be set so that the range of the current changes also depending on information (basis weight) relating to the thickness of the recording material P or information relating to the surface property of the recording material P. The range of the current which may be passed through the sheet passing portion may also be set as a calculation formula. Further, the range of the current which may be passed through the sheet passing portion may also be set as a plurality of table data or calculation formulas for each of sizes of the recording materials P.

Next, on the basis of the information on the width of the recording material P, included in the information on the job, acquired in S102, the controller 50 corrects the range, acquired in S201, of the current which may be passed through the sheet passing portion (S202). The range of the current acquired in S201 meets the width (297 mm) corresponding to the A4 size. For example, in the case where the width of the recording material P actually used in the image formation is a width (148.5 mm) corresponding to a width in A5 short edge feeding, i.e., in the case where the width is ½ of the width corresponding to the A4 size, the current range is corrected to a current range proportional to the width of the recording material P so that the upper limit and the lower limit which are acquired in S201 become ½ of these limits, respectively.

Next, the controller 50 acquires the current flowing through the non-sheet passing portion on the basis of the following pieces of information (S203). The pieces of information are the information on the width of the recording material P, included in the information on the job, acquired in S102, the information on the relationship, acquired in S105, between the voltage and the current of the secondary transfer portion N2 in the state in which the recording material P is absent in the secondary transfer portion N2, and the information on the secondary transfer voltage Vtr acquired in S106. For example, in the case where the width of the secondary transfer roller 8 is 338 mm and the width of the recording material P acquired in S102 is the width (148.5 mm) corresponding to the width in the A5 short edge feeding, the width of the non-sheet passing portion is 189.5 mm obtained by subtracting the width of the recording material P from the width of the secondary transfer roller 8. Further, it is assumed that the secondary transfer voltage Vtr acquired in S106 is, for example, 1000 V and that from the relationship between the voltage and the current acquired in S105, the current corresponding to the secondary transfer voltage Vtr is 40 μA. In this case, the current flowing through the non-sheet passing portion correspondingly to the above-described secondary transfer voltage Vtr can be acquired from the following calculation:

$$40\ \mu A \times 189.5\ mm/338\ mm = 22.4\ \mu A.$$

That is, by a proportional calculation such that the current of 40 μA corresponding to the above-described secondary transfer voltage Vtr is made small correspondingly to a ratio of the width of 189.5 mm of the non-sheet passing portion to the width of 338 mm of the secondary transfer roller 8, it is possible to acquire the current flowing through the non-sheet passing portion.

Next, the controller 50 acquires the upper limit and the lower limit (the "secondary transfer current range") of the secondary transfer current when the recording material P passes through the secondary transfer portion N2 by adding the non-sheet passing portion current acquired in S203 to each of the upper limit and the lower limit of the sheet passing portion current acquired in the S202 (S204). For example, the case where the range of the current which may be passed through the sheet passing portion corresponding to the A4 size corresponding width acquired in S201 is 20 μA in upper limit and 15 μA in lower limit will be considered. In this case, when the width of the recording material P actually used in the image formation is the width corresponding to the width in the short edge feeding, the upper limit of the range of the current which may be passed through the sheet passing portion is 10 μA, and the lower limit of the range of the current which may be passed through the sheet passing portion is 7.5 μA. Then, when the current flowing through the non-sheet passing portion acquired in S203 is 22.4 μA as in the above-described example, the upper limit of the secondary transfer current range is 32.4 μA and the lower limit of the secondary transfer current range is 29.9 μA.

With reference to part (a) of FIG. 4, next, the controller 50 compares the secondary transfer current value detected by the current detecting circuit 21 and the secondary transfer current range acquired in S107 with each other in a period in which the recording material P exists in the secondary transfer portion N2 from when the recording material P reaches the secondary transfer portion N2 (S108, S109). Then, the controller 50 corrects the secondary transfer voltage Vtr outputted by the secondary transfer voltage source 20, as needed (S110, S111). That is, in the case where the detected secondary transfer current value is a value (not less than the lower limit and not more than the upper limit) of the secondary transfer current range acquired in S107, the controller 50 maintains the secondary transfer voltage Vtr outputted by the secondary transfer voltage source 20 as it is without changing the secondary transfer voltage Vtr (S110). On the other hand, in the case where the detected secondary transfer current value deviates (being less than the lower limit or exceeds the upper limit) from the secondary transfer current range acquired in S107, the controller 50 corrects the secondary transfer voltage Vtr outputted by the secondary transfer voltage source 20 so that the value falls within the secondary transfer current range (S111). In this embodiment, in the case where the secondary transfer current value exceeds the upper limit, the controller 50 lowers the secondary transfer voltage Vtr and stops correction of the secondary transfer voltage Vtr at the time when the secondary transfer current is below the upper limit, and maintains the secondary transfer voltage Vtr at that time. Typically, the secondary transfer voltage Vtr is stepwisely lowered in a predetermined decrement. Further, in this embodiment, in the case where the secondary transfer current value is below the lower limit, the controller 50 increases the secondary transfer voltage Vtr and stops the correction of the secondary transfer voltage Vtr at the time when the secondary transfer current exceeds the lower limit, and maintains the secondary transfer voltage Vtr at that time. Typically, the secondary transfer voltage Vtr is stepwisely increased in a predetermined increment. More specifically, the controller 50 repeats the processes of S108-S111 during passing of the recording material P through the secondary transfer portion N2, and when the secondary transfer current becomes a value of the secondary transfer current range, the controller 50 stops the correction of the secondary transfer voltage Vtr and maintains the secondary transfer voltage Vtr at the secondary transfer voltage Vtr at that time.

Further, the controller 50 repeats the processes of S108-S111 until all the images in the job are completely transferred and outputted (S112).

Thus, the image forming apparatus 100 of this embodiment includes the detecting portion 21 for detecting the current flowing through the transfer member 8. Further, the image forming apparatus 100 includes the controller 50 for carrying out the constant-voltage control so that the voltage applied to the transfer member becomes a predetermined voltage when the recording material P passes through the transfer portion N2. This controller 50 is capable of changing the voltage applied to the transfer member 8 so that a detection result detected by the detecting portion 21 during the transfer falls within a predetermined range. Further, this controller 50 changes the above-described predetermined range on the basis of the detection result detected by the detecting portion 21 when the voltage is applied to the transfer member 8 in a state in which the recording material P is absent in the transfer portion N2. In this embodiment, the controller 50 changes the above-described predetermined range on the basis of the information on the current flowing through the transfer member 8 in this case where the above-described predetermined voltage is applied to the transfer member 8 in the state in which the recording material P is absent in the transfer portion N2. Particularly, in this embodiment, the controller 50 acquires the voltage-current characteristic between the voltage applied to the transfer member 8 in the state in which the recording material P is absent in the transfer portion N2 and the current flowing through the transfer member 8. Further, on the basis of the acquired voltage-current characteristic, the controller 50 acquires the current flowing through the transfer member 8 in the case where the above-described predetermined voltage is applied to the transfer member 8 in the state in which the recording material P is absent in the transfer portion N2. Further, the controller 50 changes the predetermined range on the basis of the acquired current. Further, in this embodiment, the controller 50 changes the predetermined range on the basis of the information on the current flowing through the transfer member 8 in the case where the predetermined voltage is applied to the transfer member 8 in the state in which the recording material P is absent in the transfer portion N2 and on the basis of the size information with respect to the widthwise direction substantially perpendicular to the feeding direction of the recording material P. Here, in this embodiment, the controller 50 is capable of setting the predetermined range in the following manner in the case where the image is formed on the predetermined recording material P. That is, the controller 50 sets the predetermined range at a first predetermined range in the case where the current indicated by the information on the current flowing through the transfer member 8 in the case where the predetermined voltage is applied to the transfer member 8 in the state in which the recording material P is absent in the transfer portion N2 is a first current. Further, the controller 50 sets the predetermined range at a second predetermined range in the case where the current indicated by the information on the current flowing through the transfer member 8 in the case where the predetermined voltage is applied to the transfer member 8 in the state in which the recording material P is absent in the transfer portion N2 is a second current higher than the first current. At this time, an absolute value of the upper limit of the first predetermined range is smaller than an absolute value of the upper limit of the second predetermined range. For example, as shown in part (a) of FIG. 11, in the case where the image is formed on an A4-size recording material P, in a case that the electric resistance of the transfer member 8 is a certain value and a current flowing when the predetermined voltage is applied is the first current, the first predetermined range of the transfer current is set at 18.6-24.4 μA. On the other hand, for example, as shown in part (b) of FIG. 11, in the case where the image is formed on the A4-size recording material P, in a case that the electric resistance of the transfer member 8 is a value smaller than the above-described certain value and that the output flowing when the predetermined voltage is applied is the second current higher than the first current, setting is made as follows. That is, in this case, the second predetermined range of the transfer current is 19.2-25 μA. Thus, an absolute value (24.4 μA) of the upper limit of the first predetermined range is smaller than an absolute value (25 μA) of the upper limit of the second predetermined range. Further, as absolute value (18.6 μA) of the lower limit of the first predetermined range is smaller than an absolute value (19.2 μA) of the lower limit of the second predetermined range.

Further, in this embodiment, the image forming apparatus 100 includes the storing portion 53 for storing pieces of information on the above-described predetermined ranges depending on the recording materials P. Further, in this embodiment, the controller 50 changes the predetermined range on the basis of the information on the current flowing through the transfer member 8 when the voltage is applied to the transfer member 8 in the state in which the recording material P is absent in the transfer portion N2 and the information on the predetermined range stored in the storing portion 53. For example, in the case where the image is formed on the A4-size recording material P as a first recording material, depending on the electric resistance of the transfer member 8, the first predetermined range of the transfer current is set at 18.6-24.4 μA (part (a) of FIG. 11) and 19.2-25 μA (part (b) of FIG. 11). On the other hand, in the case where the image is formed on the A5R-size recording material P as a second recording material, depending on the electric resistance of the transfer member 8, the second predetermined range of the transfer current is set at 24.1-30.3 μA (part (a) of FIG. 11) and 26.9-33.1 μA (part (b) of FIG. 11). Thus, the absolute value (24.4 μA or 25 μA) of the upper limit of the first predetermined range is smaller than the absolute value (30.3 μA or 33.1 μA) of the upper limit of the second predetermined range. Further, the absolute value (18.6 μA or 19.2 μA) of the lower limit of the first predetermined range is smaller than the absolute value 24.1 μA or 26.9 μA) of the lower limit of the second predetermined range. Further, a first difference which is a difference between the upper limit and the lower limit of the first predetermined range is smaller than a second difference which is a difference between the upper limit and the lower limit of the second predetermined range.

Further, in this embodiment, in the case where a length of the recording material P with respect to a widthwise direction substantially perpendicular to the feeding direction of the recording material P is a predetermined length, the controller 50 is capable of making the predetermined range different depending on one of the following. At least one of a temperature or humidity of at least one of an inside portion or an outside portion of the image forming apparatus 100, an index value relating to a thickness of the recording material P, and an index value relating to surface roughness of the recording material exists. Further, in this embodiment, the controller 50 acquires the voltage-current characteristic on the basis of a detection result of the detecting portion 21 when different voltages or currents of three levels or more are supplied from the voltage source 20 to the transfer portion N2 in the state in which the recording material P is absent in the transfer portion N2. Further, in this embodiment, the voltage-current characteristic is represented by a polynomial expression of a quadratic or higher degree in which the current is expressed by the voltage.

As described above, in this embodiment, the current flowing through the non-sheet passing portion when the recording material P passes through the secondary transfer portion N2 is predicted by acquiring the information on the electric resistance of the secondary transfer portion N2 before the recording material P reaches the secondary transfer portion N2. Then, by adding the predicted current flowing through the non-sheet passing portion and the range of the current which may be passed through the sheet passing portion to each other from a viewpoint of suppression of the image defect, the secondary transfer current range when the recording material P passes through the secondary transfer portion N2 is determined. Further, the secondary transfer voltage when the recording material P passes through the secondary transfer portion N2 is controlled so as to become a value of the secondary transfer current range thereof. By this, it becomes possible to output a proper image irrespective of the electric resistances of the secondary transfer portion N2 (principally the secondary transfer roller 8 in this embodiment) and the recording material P which fluctuate in various situations.

Incidentally, in this embodiment, in S107, on the basis of the current flowing through the secondary transfer portion N2 when the voltage is applied to the secondary transfer portion N2 during non-sheet passing when the recording material does not pass through the secondary transfer portion N2, a range of an allowable current flowing through the secondary transfer portion N2 during the transfer (during the sheet passing) was changed. However, the present invention is not limited thereto. For example, the range of the allowable current flowing through the secondary transfer portion N2 during the transfer (during the sheet passing) is made constant, and on the basis of the current flowing through the secondary transfer portion N2 when the voltage is applied to the secondary transfer portion N2 during the non-sheet passing portion, a current detection result during the sheet passing may also be corrected. That is, on the basis of a detection result detected by the detecting portion 21 when the voltage is applied to the transfer member 8 in the state in which the recording material P is absent in the transfer portion N2, the controller 50 corrects the detection result detected by the detecting portion 21 during the transfer, so that the controller 50 is capable of changing the voltage applied to the transfer member 8 so that the corrected value falls within the predetermined range. Description will be made more specifically. On the basis of the detection result detected by the detecting portion 21, the controller 50 is capable of acquiring the voltage-current characteristic which is the relationship between the voltage when the voltage is applied to the transfer member 8 in the state in which the recording material is absent in the secondary transfer portion N2 and the current flowing through the secondary transfer portion N2. Then, on the basis of the acquired voltage-current characteristic, the controller 50 is capable of acquiring current information on the current flowing through the transfer member in the case where the predetermined voltage is applied to the transfer member 8 in the state in which the recording material is absent in the secondary transfer portion N2. Further, on the basis of the acquired current information, the controller 50 is capable of correcting the detection result detected by the detecting portion 21. At this time, on the basis of the acquired voltage-current characteristic, the controller 50 is capable of correcting the detection result detected by the detecting portion 21 to a first correction value in the case where the current flowing through the secondary transfer portion N2 in the case where the predetermined voltage is applied to the transfer member 8 in the state in which the recording material is absent in the secondary transfer portion N2 is the first current. Further, the controller 50 is capable of correcting the detection result detected by the detecting portion 21 to a second correction value smaller than the first correction value in the case where the current flowing through the secondary transfer portion N2 in the case where the predetermined voltage is applied to the transfer member 8 in the state in which the recording material is absent in the secondary transfer portion N2 is the second current higher than the first current. By doing so, it is possible to correct a fluctuation component of the output flowing through the non-sheet passing portion. As a result of this, it becomes possible to suppress that the sheet passing portion current cannot be controlled within a proper range due to a resistance fluctuation of the non-sheet passing portion.

Embodiment 2

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In the embodiment 1, the range of the current which may be passed through the sheet passing portion when the recording material P passes through the secondary transfer portion N2 was provided with latitude from the lower limit to the upper limit. However, it is desired in some instances that the range of the current which may be passed through the sheet passing portion is relatively narrow and that the current is substantially made constant as a target current (that is, the upper limit and the lower limit of the current range in the embodiment 1 are substantially made identical to each other). In this case, the secondary transfer voltage applied to the secondary transfer roller 8 when the recording material P passes through the secondary transfer portion N2 is subjected to constant-current control such that the current flowing through the secondary transfer roller 8 is controlled to a substantially certain value. Also in this case, relative to the current intended to be controlled to the certain value, a current flowing through the non-sheet passing portion fluctuates in some instances due to a fluctuation in electric resistance of the non-sheet passing portion. Accordingly, a secondary transfer current value obtained by adding the current flowing through the sheet passing portion which is a control object and the current flowing through the non-sheet passing portion fluctuates. That is, a phenomenon such that the secondary transfer current value which is the sum of the sheet passing portion current and the non-sheet passing portion current changes due to the fluctuation in electric resistance of the non-sheet passing portion is a problem to be considered not only in the case where the secondary transfer current value is provided with the latitude but also in the case where the secondary transfer current value is controlled to a substantially certain value.

Therefore, in this embodiment, in a constitution in which the current passed through the sheet passing portion is controlled to the substantially certain value at the target current, similarly as in the embodiment 1, the electric resistance of the secondary transfer portion N2 is detected before the recording material P reaches the secondary transfer portion N2. Further, on the basis of the detection result thereof, a target value ("secondary transfer current target value") of the secondary transfer current when the recording material P passes through the secondary transfer portion N2 is acquired.

Figure 8:
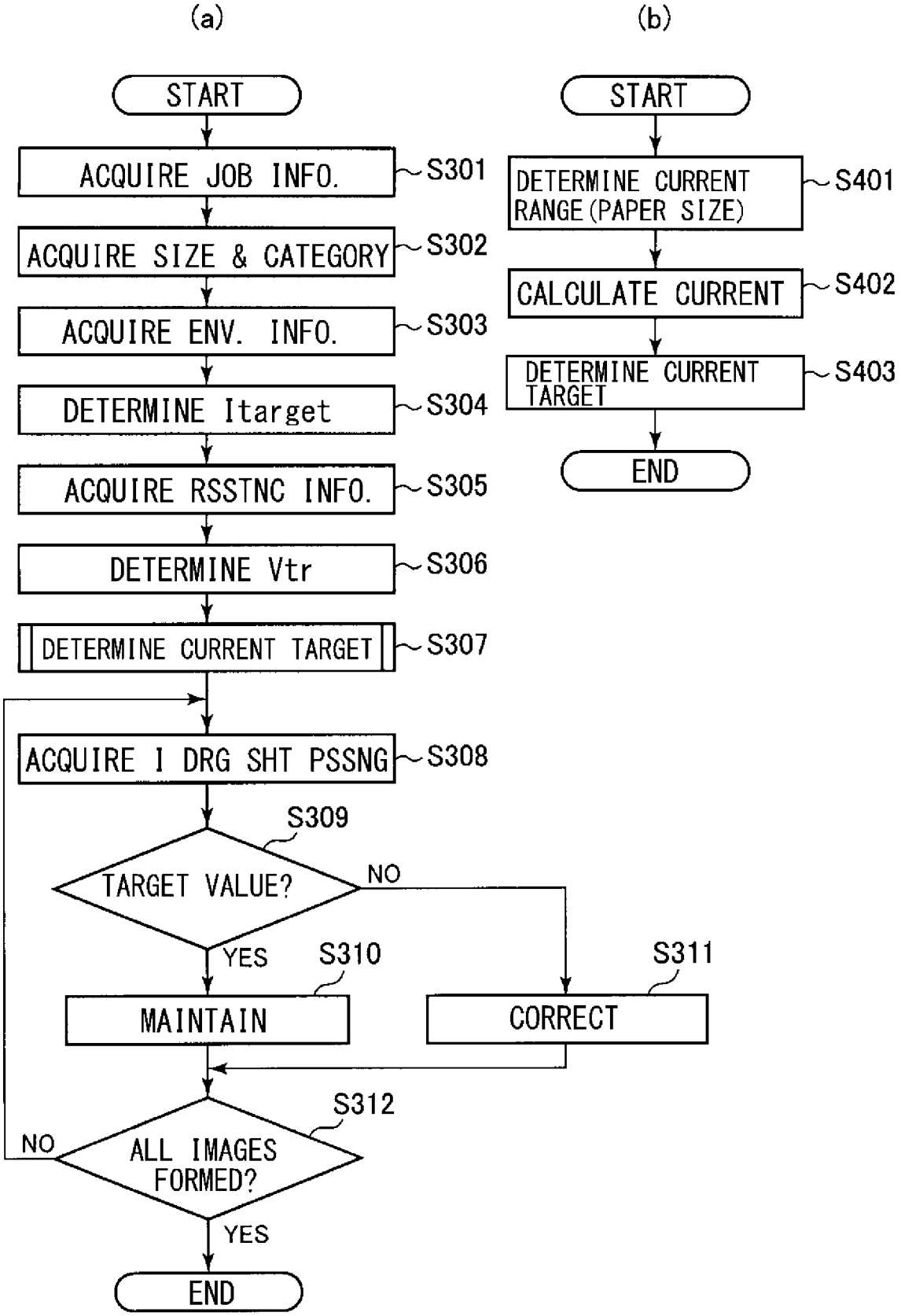
FIG. 8 includes flowcharts of control in an embodiment 2.

FIG. 8 includes flowcharts showing an outline of a procedure of control of the secondary transfer voltage in this embodiment. Processes of S301 to S312 of part (a) of FIG. 8 are similar to S101 to S112, respectively, of part (a) of FIG.

4 in the embodiment 1. However, in this embodiment, the process (process for determining the secondary transfer current target value) of S307 of part (a) of FIG. 8 corresponding to the process (process for determining the secondary transfer current range) of S107 of part (a) of FIG. 4 in the embodiment 1 is different from the process in the embodiment 1. Further, in this embodiment, the process (process for comparing the secondary transfer current with the secondary transfer current target value) of S309 of part (a) of FIG. 8 corresponding to the process (process for comparing the secondary transfer current with the secondary transfer current range) of S109 of part (a) of FIG. 4 in the embodiment 1 is different from the process in the embodiment 1. Part (b) of FIG. 8 shows a procedure of the process for determining the secondary transfer current target value in S307 of part (a) of FIG. 8. In the following, a point different from particularly the embodiment 1 will be described, and description about the processes similar to those of the embodiment 1 will be omitted.

In this embodiment, in the ROM 53, as shown in FIG. 9, information for acquiring a value "(sheet passing portion current (passing portion current)" of a current which may be passed through the secondary transfer portion N2 when the recording material P passes through the secondary transfer portion N2, from the viewpoint of suppression of the image defect is stored. In this embodiment, this information is set as a table data showing a relationship between the ambient water content and the current which may be passed through the sheet passing portion. Incidentally, the range of the current which may be passed through the sheet passing portion changes depending on the width of the recording material P. In this embodiment, the above-described table data is set on the assumption that the recording material P is a recording material of 297 mm in width corresponding to an A4 size. Further, in this embodiment, the width of the secondary transfer portion N2 is 338 mm corresponding to the secondary transfer roller 8. Accordingly, the target current Itarget in the state in which the recording material P is absent is a value which is 338/297 (≈1.14 time) the value of the current shown in a table data of FIG. 9. Here, from the view point of suppressing the image defect the current value which may be passed through the sheet passing portion changes in some instances also depending on a thickness and a surface property of the recording material P as a factor other than the environmental information. For that reason, the table data may also be set so that the current value changes also depending on information (basis weight) relating to the thickness of the recording material P or information relating to the surface property of the recording material P. The current value which may be passed through the sheet passing portion may also be set as a calculation formula. Further, the current value which may be passed through the sheet passing portion may also be set as a plurality of table data or calculation formulas for each of sizes of the recording materials P. Further, as described in the embodiment 1, the reason why the target current Itarget is changed depending on the environmental information is that the toner charge amount changes depending on the environment. For that reason, similarly as described in the embodiment 1, the target current Itarget may also be changed depending on another change mode. In this embodiment, in S304 of part (a) of FIG. 8, by making reference to the table data shown in this FIG. 9, the target current Itarget if acquired and written in the RAM 52.

By making reference to part (a) of FIG. 8, the controller 50 performs the process of determining the target value ("secondary transfer current target value") of the secondary transfer current when the recording material P passes through the secondary transfer portion N2 (S307). By making reference to part (b) of FIG. 8, on the basis of the information on the width of the recording material P, included in the information on the job, acquired in S302, the controller 50 corrects the current value (acquires the target current Itarget from this current value in S304), acquired in S304, which may be passed through the sheet passing portion (S401). The current value acquired in S304 meets the width (297 mm) corresponding to the A4 size. For example, in the case where the width of the recording material P actually used in the image formation is a width (148.5 mm) corresponding to a width in A5 short edge feeding, i.e., in the case where the width is ½ of the width corresponding to the A4 size, the current range is corrected to a current range proportional to the width of the recording material P so that the current value acquired in S304 becomes ½ thereof.

Next, the controller 50 acquires the current flowing through the non-sheet passing portion on the basis of the following pieces of information (S402). The pieces of information are the information on the width of the recording material P, included in the information on the job, acquired in S302, the information on the relationship, acquired in S305, between the voltage and the current of the secondary transfer portion N2 in the state in which the recording material P is absent in the secondary transfer portion N2, and the information on the secondary transfer voltage Vtr (=Vb+Vp) acquired in S306. Similarly as in the embodiment 1, on the basis of the target current Itarget written in the RAM 52 is S304 and the relationship between the voltage and the current acquired in S305, the controller 50 acquires the voltage value Vb necessary to cause the target current Itarget through the secondary transfer portion N2 in the state in which the recording material P is absent in the secondary transfer portion N2. Further, the controller 50 acquires Vp similarly as in the embodiment 1. The process of S402 of part (b) of FIG. 8 is similar to the process of S203 of part (b) of FIG. 4 in the embodiment 1.

Next, the controller 50 acquires secondary transfer current target value when the recording material P passes through the secondary transfer portion N2 by adding the non-sheet passing portion current acquired in S402 to the sheet passing portion current acquired in the S401 (S403). For example, the case where the value of the current which may be passed through the sheet passing portion corresponding to the A4 size corresponding width acquired in S304 is 18 μA will be considered. In this case, when the width of the recording material P actually used in the image formation is the width corresponding to the width in the short edge feeding, the value of the current which may be passed through the sheet passing portion is 9 μA. Then, when the current flowing through the non-sheet passing portion acquired in S402 is 22.4 μA similarly as in the example described in the embodiment 1, the secondary transfer current target value is 31.4 μA.

With reference to part (a) of FIG. 8, next, the controller 50 compares the secondary transfer current value detected by the current detecting circuit 21 and the secondary transfer current target value acquired in S403 with each other in a period in which the recording material P exists in the secondary transfer portion N2 (S308, S309). Then, the controller 50 corrects the secondary transfer voltage Vtr outputted by the secondary transfer voltage source 20, as needed (S310, S311). Here, in this embodiment, in a predetermined period (initial stage) from when the recording material P reaches the secondary transfer portion N2, the secondary transfer voltage Vtr determined in S306 is applied. This is because in the case of a system in which the electric resistance largely fluctuates depending on the presence or absence of the recording material P, when the voltage is intended to be applied under constant-current control from the state in which the recording material P is absent, the voltage value largely fluctuates and the flowing current rather becomes unstable. For that reason, in this embodiment, in an initial stage of the period in which the recording material P passes through the secondary transfer portion N2, a certain voltage was applied. Then, from after a lapse of a predetermined period (for example a period until a leading end marginal portion of the recording material P completely passes through the secondary transfer portion N2) after a leading end of the recording material P with respect to the feeding direction enters the secondary transfer portion N2, the voltage was applied so that the secondary transfer current value becomes a certain current value. In the case where the detected secondary transfer current value is a substantially identical to (may also be different within an allowable control error range from) the secondary transfer current target value acquired in S403, the controller 50 maintains the secondary transfer voltage Vtr outputted by the secondary transfer voltage source 20 as it is without changing the secondary transfer voltage Vtr (S310). On the other hand, in the case where the detected secondary transfer current value deviates from the secondary transfer current target value acquired in S403, the controller 50 corrects the secondary transfer voltage Vtr outputted by the secondary transfer voltage source 20 so that the value falls within the secondary transfer current target value (S311). In this embodiment, the controller 50 stops correction of the secondary transfer voltage Vtr at the time when the secondary transfer current value is substantially identical to the secondary transfer current target value, and maintains the secondary transfer voltage Vtr at that time.

Thus, in this embodiment, of the period in which the recording material P passes through the transfer portion N2, in a first period in which a predetermined leading end portion of the recording material P passes through the transfer portion N2, the controller 50 carries out the constant-voltage control so that the predetermined voltage is applied to the transfer member 8. Further, in a second period subsequent to the first period, the controller 50 subjects the current flowing through the transfer member 8 to the constant-current control on the basis of the detection result of the detecting portion 21 so that the current flowing through the transfer member 8 is a predetermined current. Then, the controller 50 changes the above-described predetermined current on the basis of the information on the current flowing through the transfer member 8 in this case where the above-described predetermined voltage is applied to the transfer member 8 in the state in which the recording material P is absent in the transfer portion N2.

As described above, in this embodiment, the current flowing through the non-sheet passing portion when the recording material P passes through the secondary transfer portion N2 is predicted by acquiring the information on the electric resistance of the secondary transfer portion N2 before the recording material P reaches the secondary transfer portion N2. Then, by adding the predicted current flowing through the non-sheet passing portion and the value of the current which may be passed through the sheet passing portion to each other from a viewpoint of suppression of the image defect, the secondary transfer current target value when the recording material P passes through the secondary transfer portion N2 is determined. Further, the secondary transfer voltage when the recording material P passes through the secondary transfer portion N2 is controlled so as to become the secondary transfer current target value thereof. By this, it becomes possible to output a proper image irrespective of the electric resistances of the secondary transfer portion N2 (principally the secondary transfer roller 8 in this embodiment) and the recording material P which fluctuate in various situations.

Embodiment 3

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In the embodiments 1 and 2, the relationship between the voltage and the current as the information on the electric resistance of the secondary transfer portion N2 was acquired by taking measuring voltage or current as multiple levels of three or more points. This is because the relationship between the voltage and the current was represented by the polynomial expression of the quadratic or more degree in which the current is expressed by the voltage. However, when the number of data to be acquired is increased, a time required for control carried out until the recording material P reaches the secondary transfer portion N2 becomes long, so that the time has the influence on productivity of image output in some cases.

In this embodiment, the image forming apparatus 100 is capable of executing, in the following first mode and second mode, an operation of acquiring the information on the electric resistance of the secondary transfer portion N2, which is performed until the recording material P reaches the secondary transfer portion N2. The first mode is a mode which is performed in a pre-multi-rotation step such as the time of ON of a main switch of the image forming apparatus 100 or after restoration from jam clearance and in which a control time is relatively long. The second mode is a mode which is performed at timing other than the above-described timing, typically in a pre-rotation step of each of jobs and in which the control time is shorter than the control time of the first mode. That is, in the pre-rotation step of each job, this second mode can be executed in the case where the relationship between the voltage and the current in the secondary transfer portion N2 is acquired by the process of S105 of FIG. 4 in the embodiment 1 or by the process of S305 of FIG. 8 in the embodiment 2.

In the first mode, data are acquired by taking the measuring voltage or current as multiple levels of three or more points. The method of acquiring the relationship between the voltage and the current in the first mode is the same as the method described in the embodiment 1.

On the other hand, in the second mode, the measuring voltage or current is one point or two points. Further, the relationship between the voltage and the current is acquired by making reference to a result of the first mode (typically the first mode last performed) carried out before the second mode and a result of the second mode of this time.

For example, it is assumed that as a result of the last performed first mode, the relationship between the voltage and the current of the secondary transfer portion N2 is a quadratic function as in the following formula 1. Here, a, b and c in the following formula 1 are coefficient acquired from the result of the first mode.

$$I=aV^2+vB+c \quad \text{(formula 1)}$$

Further, it is assumed that the current flowed through the secondary transfer portion N2 is I2 as a result of the second mode which was performed after the first mode and in which the measuring voltage or current was one point which was a voltage V0 was I2.

Further, it is assumed that by applying the voltage V0 to the above-described formula 1, a current I1 is calculated by the following formula 2.

$$I1=aV1^2+bV1+c \quad \text{(formula 2)}$$

In this case, the relationship between the voltage and the current as a result of the second mode is acquired as in the following formula 3 by a proportional calculation between the above-described I1 and I2.

$$I=I2/I1*(aV^2+bV+c) \quad \text{(formula 3)}$$

Thus, in this embodiment, the controller 50 is capable of selectively executing subsequent first mode and second mode. The first mode is a mode in which the voltage-current characteristic which is the relationship between the voltage when the voltage is applied to the transfer member 8 and the current flowing through the transfer member 8, on the basis of the detection result of the detecting portion 21 when three levels or more of different voltages or currents are supplied from the voltage source 20 to the transfer member 8 in the state in which the recording material P is absent in the transfer portion N2. The second mode is a mode in which the voltage-control characteristic is acquired on the basis of the detection result of the detecting portion 21 when the voltage or the current of a level smaller in number than the levels in the first mode is supplied from the voltage source to the transfer portion in the state in which the recording material P is absent in the transfer portion and the result of the first mode performed in advance.

As described above, in this embodiment, not only an effect similar to the effects of the embodiments 1 and 2 is obtained, but also a lowering in productivity of image output can be suppressed by shortening a time required for the control carried out before the recording material P reaches the secondary transfer portion N2.

Embodiment 4

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

As described in the embodiments 1 to 3, by providing the sheet passing portion current range, it is possible to suppress image defects such as a poor image density and white void. However, only when the sheet passing portion current range is provided, image defect such as "penetration" for which it is difficult to predict occurrence or non-occurrence exists. The penetration is the image defect such that when the recording material P during passing thereof through the secondary transfer portion N2 is subjected to electric discharge, toner at an associated portion is not transferred onto the recording material P and a dot-shaped white void occurs.

FIG. 12 is a table showing an example of a relationship, between the sheet passing portion current and the occurrence or non-occurrence of the penetration, checked in the following manner. "x" represents that the penetration occurred, and "o" represents that the penetration did not occur. An experimental environment was NL (temperature: 23° C., humidity: 5%). As the recording material P, a commercially available A4-size paper was used. An experiment such that occurrence or non-occurrence of penetration was checked by using paper in each of a state just taken out of a commercially available individual package (Just after unpacking) and a state after being left standing for 24 hours in the NL environment (after left standing) and then by changing the sheet passing portion current was conducted. From a result of FIG. 12, it is understood that the penetration occurs at a lower sheet passing portion current in the case where the paper after left standing is used than in the case where the paper just after taken out of the individual package. Thus, for example, even when the kind of the recording material P is the same, the sheet passing portion current at which the penetration occurs is different depending on a left-standing state. Accordingly, it is difficult to realize suppression of the penetration which is a problem other than the poor image density and the white void only when the sheet passing portion current range is provided.

Figure 13:
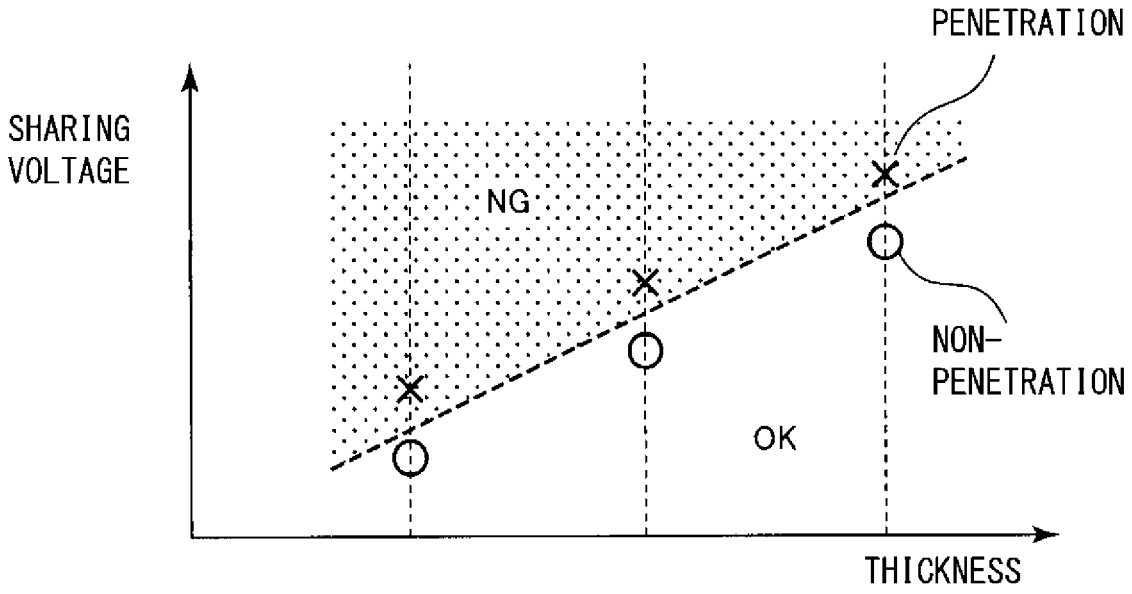
FIG. 13 is a view (graph) for illustrating a relationship between a recording material part (sharing) voltage and penetration.

Here, as regards the penetration, it turns out by an experiment that as the thickness of the recording material P becomes thick, a value of the recording material part (sharing) voltage when the penetration occurs becomes large. FIG. 13 is a graph showing an outline of a relationship between the thickness of the recording material P and the recording material part voltage (absolute value) during the secondary transfer. In this embodiment, by utilizing the relationship, an upper limit (absolute value) of the recording material part voltage is provided for each of paper kinds (thicknesses). By this, while suppressing the occurrence of the penetration, it becomes possible to carry out control of the secondary transfer current similarly as in the embodiments 1 to 3.

Figure 14:
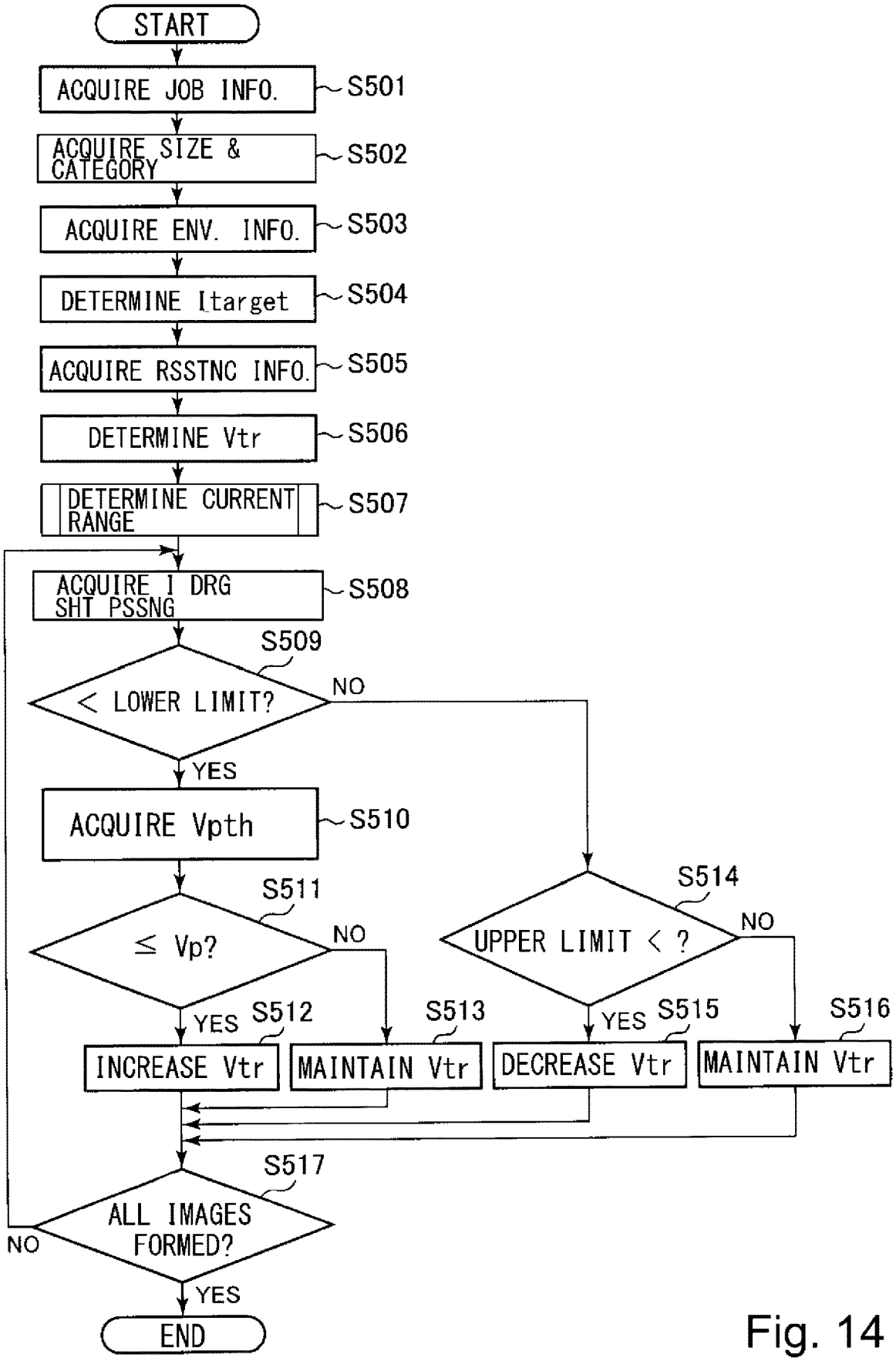
FIG. 14 is a flowchart of control in the embodiment 3.

FIG. 14 is a flowchart showing an outline of procedure of control of the secondary transfer voltage in this embodiment. Processes S501 to S508 of FIG. 14 are similar to S101 to S108 of part (a) of FIG. 4, respectively, in the embodiment 1. Further, in this embodiment, procedure of a process of determining the secondary transfer current range in S507 is similar to the procedure of the processes of S201 to S204 shown in part (b) of FIG. 4 in the embodiment 1.

Figure 15:
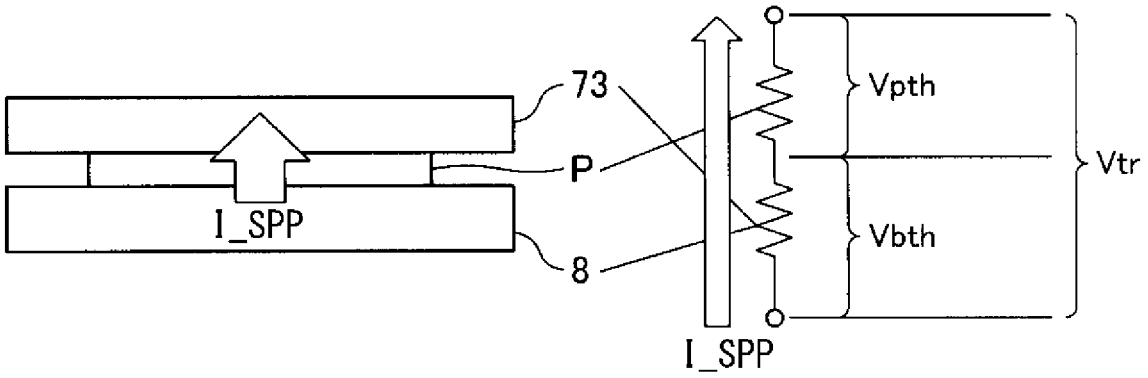
FIG. 15 includes schematic views for illustrating a deriving method of the recording material part voltage.
Figure 15:
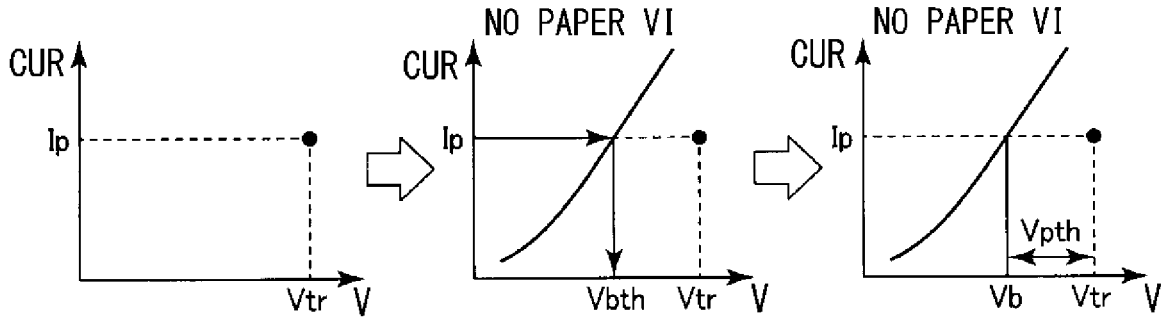

The controller 50 discriminates whether or not the secondary transfer current value, detected by the current detecting circuit 21, during passing of the recording material P through the secondary transfer portion N2 is less than the lower limit of the secondary transfer current range acquired in S507 (S509). In the case where the controller 50 discriminated that the secondary transfer current value is less than the lower limit ("Yes") in S509, the controller 50 acquires an actual recording material part voltage Vpth (S510). Here, the actual recording material part voltage Vpth is different from the recording material part voltage Vp which is determined in advance as shown in FIG. 6 and which is stored in the ROM 53, and is an actually calculated value during the secondary transfer. A calculating method of the actual recording material part voltage Vpth will be described using FIG. 15. As shown in part (a) of FIG. 15, during the secondary transfer, to the secondary transfer roller 8, the secondary transfer opposite roller 73 and the recording material P, the secondary transfer voltage Vtr is applied, so that the sheet passing portion current flows through these members. In part (a) of FIG. 15, Vtr represents the secondary transfer voltage, Vpth represents the actual recording material part voltage, and Vbth represents an actual secondary transfer portion part (sharing) voltage (the voltage shared principally by the secondary transfer roller 8 and the secondary transfer opposite roller 73). As shown in part (a) of FIG. 15, the actual recording material part voltage Vpth can be calculated by subtracting the actual secondary transfer portion part voltage Vbth from the secondary transfer voltage Vtr. This will be further described with reference to part (b) of FIG. 15. The controller 50 is capable of acquiring the actual recording material part voltage Vpth on the basis of the following pieces of information. The information includes information, acquired in S502, on the width of the recording material P included in information on the job, information, acquired in S505, on the relationship between the voltage and the current of the secondary transfer portion N2 in the state in which the recording material P is absent in the secondary transfer portion N2, and information, acquired in S506, on the secondary transfer voltage Vtr. That is, as shown in a left-hand view of part (b) of FIG. 15, a sheet passing portion current Ip when the secondary transfer voltage Vtr is applied can be acquired by subtracting the non-sheet passing portion current (acquired by a process in S507 similar to the process of S203 of part (b) of FIG. 4) from the detected secondary transfer current Itr. Further, as shown in a central view of part (b) of FIG. 15, the actual secondary transfer portion part voltage Vpth when this sheet passing portion current Ip flows can be acquired from the relationship between the voltage and the current acquired by the ATVC of S505. Further, as shown in a right-hand view of part (b) of FIG. 15, the actual recording material part voltage Vpth can be acquired by calculating a difference between the secondary transfer voltage Vtr and this actual secondary transfer portion part voltage Vbth.

Next, the controller 50 discriminates whether or not the actual recording material part voltage Vpth is not more than the upper limit (threshold) (S511). In this embodiment, based on information (thickness or basis weight) relating to the thickness of the recording material, the upper limit of the actual recording material part voltage Vpth is set. Specifically, for every paper kind category (basis weight) such as "thin paper, plain paper, thick paper 1, thick paper 2 (thick paper thicker in thickness than thick paper 1) . . . ", the upper limit of the actual recording material part voltage Vpth is set in advance and is stored, as table data as shown in FIG. 16, in the ROM 53. On the basis of information, acquired in S502, on the paper kind category (basis weight) included in the information on the job, the controller 50 selects, from the table data, the upper limit of the actual recording material part voltage Vpth corresponding to the paper kind category and uses the upper limit. Incidentally, a setting method of the upper limit of the actual recording material part voltage Vpth is not limited to the method of this embodiment. For example, a relationship formula between the thickness of the recording material P and the actual recording material part voltage Vpth (upper limit, threshold) at which the penetration occurs or the like formula is stored in the ROM 53 and the thickness information of the recording material P is acquired every job and then the upper limit of the actual recording material part voltage Vpth may also be set. As an acquiring method of the thickness information of the recording material P, it is possible to cite a method in which the operator directly inputs the thickness, a method in which the thickness is measured every job by providing a thickness sensor using ultrasonic wave or the like on a side upstream of the registration roller 9 with respect to the feeding direction of the recording material P, and the like method. In the case where the controller 50 discriminated that the actual recording material part voltage Vpth is not more than the upper limit ("Yes") in S511, the controller 50 increases the secondary transfer voltage Vtr (S512). At this time, typically, the secondary transfer voltage Vtr is increased in a predetermined increment. On the other hand, in the case where the controller 50 discriminated that the actual recording material part voltage Vpth exceeds the upper limit ("No") in S511, the controller 50 maintains the secondary transfer voltage Vtr as it is without changing the secondary transfer voltage Vtr (S513).

Further, in the case where the controller 50 discriminated in S509 that the secondary transfer current value is not less than the lower limit ("No"), the controller 50 discriminates whether or not the secondary transfer current value detected by the current detecting circuit 21 and during passing of the recording material P through the secondary transfer portion N2 exceeds the upper limit of the secondary transfer current range acquired in S507 (S514). In the case where the controller 50 discriminated in S514 that the secondary transfer current value exceeds the upper limit value ("Yes"), the controller 50 lowers the secondary transfer voltage Vtr (S515). At this time, typically, the controller 50 lowers the secondary transfer voltage Vtr in a predetermined decrement. On the other hand, in the case where the controller 50 discriminated in S514 that the secondary transfer current value does not exceed the upper limit ("No."), the controller maintains the secondary transfer voltage Vtr as it is without changing the secondary transfer voltage Vtr (S516). Thereafter, the controller 50 repeats the process of S508 to S516 until all the images of the job are completely transferred and outputted onto the recording material P (S517).

In this embodiment, by the above-described control, while suppressing the occurrence of the penetration, it becomes possible to carry out the control of the secondary transfer current similarly as in the embodiments 1 to 3. Here, in this embodiment, there is a case that the secondary transfer voltage Vtr is not increased even when the secondary transfer current is less than the lower limit of the secondary transfer current range, so that the suppression of the penetration takes precedence over the suppression of the poor image density and the white void. This is because an occurrence of insufficient secondary transfer current and the penetration are considered. That is, in this embodiment, the lower limit of the secondary transfer current range is set by assuming the case where an image ratio (duty) is higher than the image ratio in an average manner of use by a user and a large secondary transfer current is needed. Accordingly, even when the secondary transfer current is below the lower limit of the secondary transfer current range, the case where transfer failure does not appear in the output image can exist. However, the penetration generates depending on the recording material part voltage Vp and appears irrespective of whether the output image is solid image or a halftone image. By such reason, in this embodiment, the suppression of the penetration takes precedence over the suppression of the poor image density and the white void.

Thus, in this embodiment, in the case where an absolute value acquired on the basis of the current flowing through the transfer member 8 when the voltage is applied to the transfer member 8 in the state in which the recording material P is absent in the transfer portion N2, the information on the width of the recording material P with respect to the direction substantially perpendicular to the feeding direction of the recording material P, and the current flowing through the transfer member 8 detected by the detecting portion 21 during the transfer exceeds the predetermined threshold, even when the absolute value of the current flowing through the transfer member 8 during the transfer is less than the lower limit of the predetermined range, the controller 50 does not increase the absolute value of the voltage applied to the transfer member 8 so that the current flowing through the transfer member 8 during the transfer falls within the predetermined range. Here, a current flowing through the non-passing region of the transfer portion N2 in which the recording material P does not pass with respect to the widthwise direction substantially perpendicular to the feeding direction of the recording material P is referred to as a non-passing portion current. At this time, in this embodiment, on the basis of the non-passing portion current acquired on the basis of the current flowing through the transfer member 8 when the voltage is applied to the transfer member 8 in the state in which the recording material P is absent in the transfer portion N2, and of the current flowing through the transfer member 8 during the transfer, the controller 50 acquires a part (sharing) voltage, as the above-described value, of the recording material P during the transfer. Further, the above-described threshold is set depending on an index value (thickness, basis weight or the like) relating to the thickness of the recording material P. Typically, than the above-described threshold for the recording material P with a first thickness as the thickness indicated by the index value, the threshold for the recording material P with a second thickness, thicker than the first thickness, indicated by the index value is larger.

Incidentally, in this embodiment, the control of limiting the increase in secondary transfer voltage Vtr depending on the actual recording material part voltage Vpth was combined with the control in the embodiment 1, but may also be combined with the control in the embodiment 2. In that case, even in the case where the secondary transfer current is less than the secondary transfer current target value, in a case that the actual recording material part voltage Vpth exceeds the upper limit, it may only be required that the increase in secondary transfer voltage Vtr is not made.

Embodiment 5

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

1. Influence Due to Thickness of Recording Material

As described above, as regards the problem such that a proper transfer current range varies due to the fluctuation of the electric resistance of the transfer member, it is possible to meet (solve) the problem by detecting the electric resistance of the secondary transfer portion N2 before the recording material P reaches the secondary transfer portion N2. However, in the case where the recording material P used in image formation is a recording material P, such as the thick paper, with a relatively large thickness or in the like case, pressure of the non-sheet passing portion lowers depending on the thickness of the recording material P. For that reason, the actual non-sheet passing portion current deviates in some instances from the value predicted before the recording material P reaches the secondary transfer portion N2.

Figure 23:
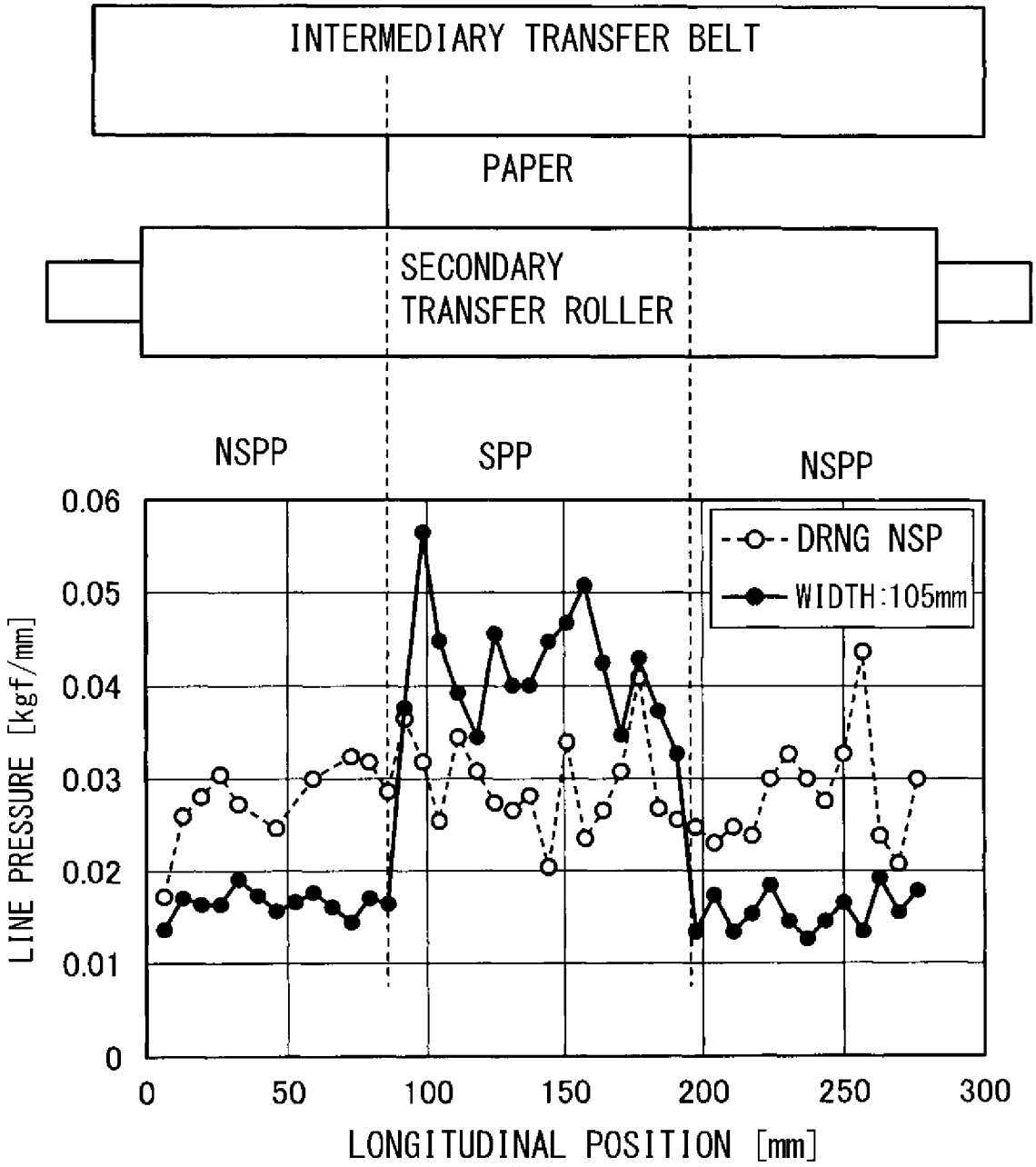
FIG. 23 is a schematic view for illustrating a problem.

FIG. 23 is a graph showing a change in pressure distribution of the secondary transfer portion N2 with respect to the direction secondary transfer portion the feeding direction of the recording material P. In an example shown in FIG. 23, the width of the recording material P is 300 mm. A plot indicated by a broken line in FIG. 23 is a result of measurement of the pressure distribution of the secondary transfer portion N2 when the recording material P is absent in the secondary transfer portion N2. On the other hand, a plot indicated by a solid line in FIG. 23 is a result of measurement of the pressure distribution when a recording material P with a basis weight of 300 g/m$^2$ and a width of 105 mm passes through the neighborhood of a central portion of the secondary transfer portion N2 with respect to the direction substantially perpendicular to the feeding direction of the recording material P. The pressure distribution (broken line in FIG. 23) of the secondary transfer portion N2 when the recording material P is absent in the secondary transfer portion N2 is substantially uniform with respect to the direction substantially perpendicular to the feeding direction of the recording material P. However, when the recording material P is present in the secondary transfer portion N2, sheet passing portion pressure (in the neighborhood of a central portion of a solid line in FIG. 23) becomes high compared with when the recording material P is absent in the secondary transfer portion N2. On the other hand, non-sheet passing portion pressure (region other than the central portion of the solid line in FIG. 23) becomes low compared with when the recording material P is absent in the secondary transfer portion N2. As the pressure of the secondary transfer portion N2 is low, a contact region between the intermediary transfer belt 7 and the secondary transfer roller 8 with respect to the feeding direction of the recording material P, and therefore, even when the same secondary transfer voltage is applied, the current flowing through the secondary transfer portion N2 becomes small. When without considering this phenomenon, when the transfer current range is determined on the basis of the non-sheet passing portion current predicted from the electric resistance of the secondary transfer portion N2 detected before the recording material P reaches the secondary transfer portion N2, the transfer current range becomes high more than necessary in some instances. As a result, in the case where the transfer current becomes excessively high, the image defect due to an electric discharge phenomenon is liable to occur.

Thus, even in the case where the recording material P, such as thick paper, relatively large in thickness is used, it is required that the occurrence of the image defect due to deviation, from a proper range, of the secondary transfer current when the recording material P passes through the secondary transfer portion N2 is suppressed.

2. Secondary Transfer Voltage Control

Figure 17:
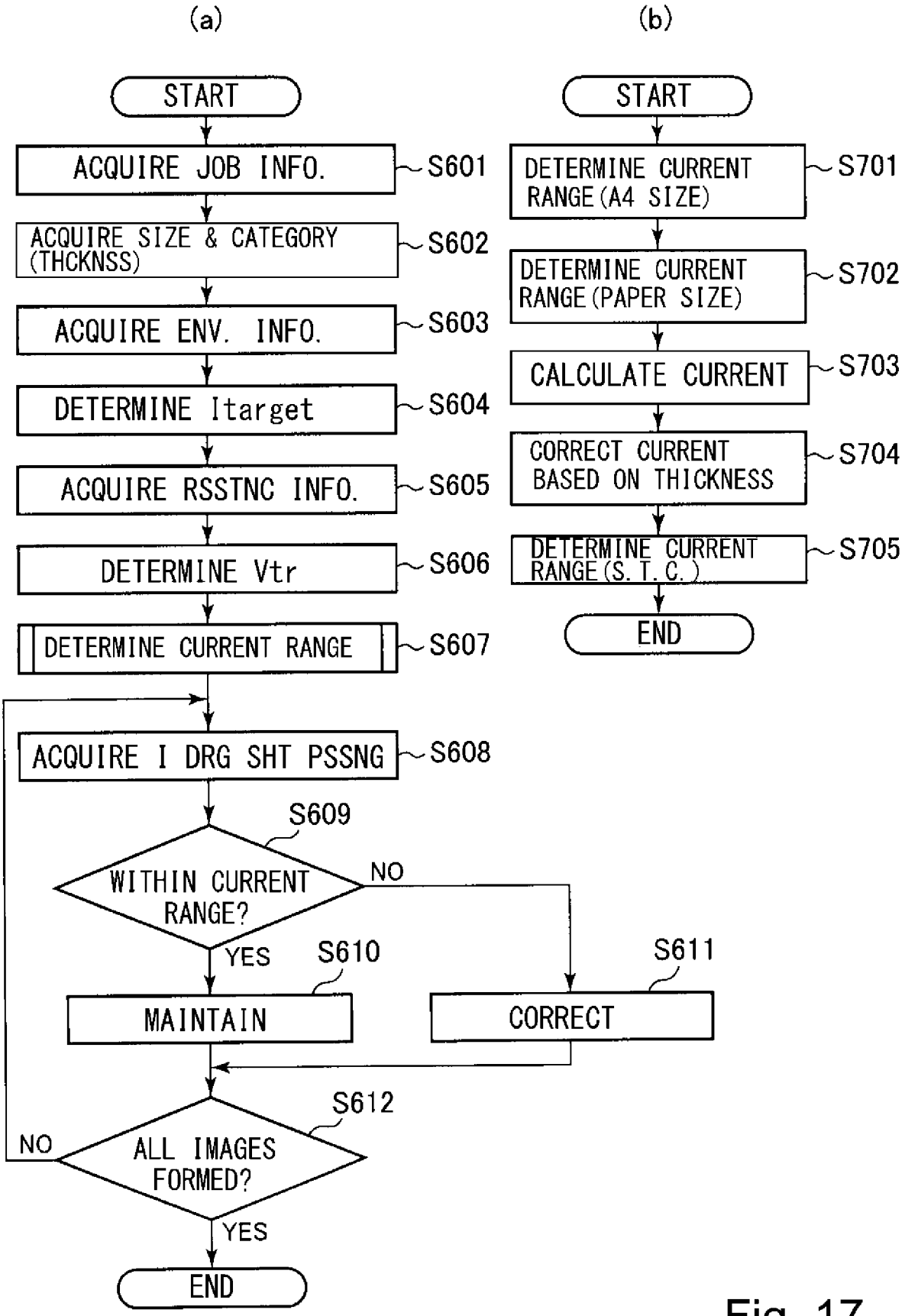
FIG. 17 includes flowcharts of control in an embodiment 5.

Next, secondary transfer voltage control in this embodiment will be described. FIG. 17 includes flowcharts showing an outline of a procedure of the secondary transfer voltage control in this embodiment. In FIG. 17, of steps of control executed by the controller 50 when a job is executed, a procedure relating to the secondary transfer voltage control is shown in a simplified manner, and other many steps of control during the execution of the job are omitted from illustration.

Incidentally, in this embodiment, the information on the thickness of the recording material P and the width of the recording material P is acquired on the basis of information inputted from the operating portion 31 and the external device 200. However, a detecting means for detecting the thickness and the width of the recording material P is provided in the image forming apparatus 100, and it is also possible to carry out control on the basis of information acquired by this detecting means.

With reference to part (a) of FIG. 17, first, when the controller 50 acquires information of the job from the operating portion 31 or the external device 200, the controller 50 causes the image forming apparatus to start the job (S601). In this embodiment, in information on this job, image information designated by the operator, information on a size (width, length) of the recording material P on which the image is formed, information (thickness, basis weight) relating to a thickness of the recording material P, and information relating to a surface property of the recording material P such that whether or not the recording material P is coated paper. That is, pieces of information on the paper size (width, length) and on a paper kind category (plain paper, thick paper and the like (including information relating to the thickness)) are included. The controller 50 writes this information on the job in the RAM 52 (S602).

Then, the controller 50 acquires environmental information detected by the environmental sensor 32 (S603). Further, in the ROM 53, information indicating a correlation between the environmental information and the target current Itarget for transferring the toner image on the intermediary transfer belt 7 onto the recording material P is stored. On the basis of the environmental information read in S603, the controller 50 acquires a target current Itarget corresponding to an environment from information indicating a relationship between the above-described environmental information and the target current Itarget, and writes this in the RAM 52 (S604).

Incidentally, the reason why the target current Itarget is changed depending on the environmental information is that a charge amount of the toner changes depending on the environment. The information indicating the relationship between the above-described environmental information and the target current Itarget is acquired by an experiment or the like in advance. Here, the charge amount of the toner is influenced by, in addition to the environment, timing when the toner is supplied to the developing device, and a use history such as an amount of the toner coming out of the developing device 4 in some instances. In order to suppress these influences, the information 100 is constituted so that the charge amount of the toner in the developing device 4 is a value within a certain range. However, in addition to the environmental information, when a factor affecting the charge amount of the toner on the intermediary transfer belt 7 is known, the target current Itarget may also be changed also depending on information thereon. Further, a measuring means for measuring the charge amount of the toner is provided in the image forming apparatus 100, and on the basis of information on the toner charge amount acquired by this measuring means, the target current Itarget may also be changed.

Next, the controller 50 acquires information on the electric resistance of the secondary transfer portion N2 before the toner image on the intermediary transfer belt and the recording material P on which the toner image is to be transferred reach the secondary transfer portion N2 (S605). In this embodiment, the information on the electric resistance of the secondary transfer portion N2 (principally the secondary transfer roller 8 in this embodiment) is acquired by the following ATVC (active transfer voltage control). That is, in a state in which the secondary transfer roller 8 and the intermediary transfer belt 7 are brought into contact with each other, a predetermined voltage or a predetermined current is applied from the secondary transfer voltage source 20 to the secondary transfer roller 8. Further, a current value when the predetermined voltage is supplied or a voltage value when the predetermined current is supplied is detected, so that a relationship between the voltage and the current (voltage-current characteristic) is acquired. This relationship between the voltage and the current changes depending on the electric resistance of the secondary transfer portion N2 (principally the secondary transfer roller 8 in this embodiment). In the constitution of this embodiment, as regards the above-described relationship between the voltage and the current, the current is not linearly changed (proportional) relative to the voltage, but as shown in FIG. 5, the current changes as represented by a polynomial expression of a quadratic or higher degree of the voltage. For that reason, in this embodiment, in order to represent the relationship between the voltage and the current by the polynomial expression, the predetermined voltage or the predetermined current supplied when the information on the electric resistance of the secondary transfer portion N2 is acquired were set at multiple levels of three or more.

Next, the controller 50 acquires a value of the voltage which should be applied from the secondary transfer voltage source 20 to the secondary transfer roller 8 (S606). That is, on the basis of the target current Itarget written in the RAM 52 in S604 and the relationship between the voltage and the current acquired in S605, the controller 50 acquires a voltage value Vb necessary to cause the target output Itarget to flow in a state in which the recording material P is absent in the secondary transfer portion N2. This voltage value Vb corresponds to a secondary transfer part (sharing) voltage. In the ROM 53, as shown in FIG. 6, information for acquiring a recording material part voltage Vp is stored. In this embodiment, this information is set as table data showing a relationship between ambient water content and the recording material part voltage Vp for each of sections of a basis weight of the recording material P. Incidentally, the controller 50 can acquire the ambient water content on the basis of the environmental information (temperature, humidity) detected by the environmental sensor 32. The controller 50 acquires the recording material part voltage Vp from the table data on the basis of the information on the basis weight of the recording material P included in the information on the job acquired in S602 and the environmental information acquired in S603. Then, as an initial value of a secondary transfer voltage Vtr applied from the secondary transfer voltage source 20 to the secondary transfer roller 8 when the recording material P passes through the secondary transfer portion N2, the controller 50 acquires Vb+Vp which is the sum of the above-described Vb and Vp and writes this in the RAM 52. In this embodiment, the controller 50 acquires the initial value of the secondary transfer voltage Vtr until the recording material P reaches the secondary transfer portion N2 and prepares for timing when the recording material P reaches the secondary transfer portion N2.

The table data for acquiring the recording material part voltage Vp as shown in FIG. 6 has been acquired by an experiment or the like in advance. Here, the recording material part voltage (a transfer voltage corresponding to the electric resistance of the recording material P) Vp also changes by a surface property of the recording material P, in addition to the information (basis weight) relating to the thickness of the recording material P. For that reason, the table data may also be set so that the recording material part voltage Vp changes also depending on information relating to the surface property of the recording material P. Further, in this embodiment, the information relating to the thickness of the recording material P (and further the information relating to the surface property of the recording material P) are included in the information on the job acquired in S601. However, the image forming apparatus 100 may also be provided with a measuring means for detecting the thickness of the recording material P and the surface property of the recording material P, and on the basis of information acquired by this measuring means, the recording material part voltage Vp may also be acquired.

Then, the controller 50 carried out a process of determining the upper limit and the lower limit ("secondary transfer current range") when the recording material P passes through the secondary transfer portion N2 (S607). Part (b) of FIG. 17 shows a procedure of the process of determining the secondary transfer current range in S607 of part (a) of FIG. 17. In the ROM 53, as shown in FIG. 7, information for acquiring a range "(sheet passing portion current range (passing portion current range)" of a current which may be passed through the secondary transfer portion N2 when the recording material P passes through the secondary transfer portion N2, from the viewpoint of suppression of the image defect is stored. In this embodiment, this information is set as a table data showing a relationship between the ambient water content, and the upper limit and the lower limit of the current which may be passed through the sheet passing portion. Incidentally, this table data is acquired by an experiment or the like in advance. By making reference to part (b) of FIG. 17, the controller 50 acquires a range of current which may be passed through the sheet passing portion from the table data on the basis of the above environmental information acquired in S603 (S701).

Incidentally, the range of the current which may be passed through the sheet passing portion changes depending on the width of the recording material P. In this embodiment, the above-described table data is set on the assumption that the recording material P is a recording material of 297 mm in width corresponding to an A4 size. Here, from the view point of suppressing the image defect the range of the current which may be passed through the sheet passing portion changes in some instances also depending on a thickness and a surface property of the recording material P as a factor other than the environmental information. For that reason, the table data may also be set so that the range of the current changes also depending on information (basis weight) relating to the thickness of the recording material P or information relating to the surface property of the recording material P. The range of the current which may be passed through the sheet passing portion may also be set as a calculation formula. Further, the range of the current which may be passed through the sheet passing portion may also be set as a plurality of table data or calculation formulas for each of sizes of the recording materials P.

Next, on the basis of the information on the width of the recording material P, included in the information on the job, acquired in S602, the controller 50 corrects the range, acquired in S701, of the current which may be passed through the sheet passing portion (S702). The range of the current acquired in S701 meets the width (297 mm) corresponding to the A4 size. For example, in the case where the width of the recording material P actually used in the image formation is a width (148.5 mm) corresponding to a width in A5 short edge feeding, i.e., in the case where the width is ½ of the width corresponding to the A4 size, the current range is corrected to a current range proportional to the width of the recording material P so that the upper limit and the lower limit which are acquired in S701 become ½ of these limits, respectively. That is, the upper limit of the sheet passing portion current before correction acquired from the table data of FIG. 7 is Ip_max, the lower limit thereof is Ip_min, and the width of the recording material P when the table data of FIG. 7 is determined is Lp_bas. Further, the width of the recording material P actually fed is Lp, the upper limit of the sheet passing portion current after the correction is Ip_max_aft, and the lower limit thereof is Ip_min_aft. At this time, the upper limit and the lower limit of the sheet passing portion current after the correction can be acquired by the following formulas 4 and 5, respectively.

$$Ip_max_aft = Lp/Lp_bas * Ip_max \quad \text{(formula 4)}$$

$$Ip_min_aft = Lp/Lp_bas * Ip_min \quad \text{(formula 5)}$$

Next, the controller 50 acquires the current flowing through the non-sheet passing portion on the basis of the following pieces of information (S703). The pieces of information are the information on the width of the recording material P, included in the information on the job, acquired in S602, the information on the relationship, acquired in S605, between the voltage and the current of the secondary transfer portion N2 in the state in which the recording material P is absent in the secondary transfer portion N2, and the information on the secondary transfer voltage Vtr acquired in S606. For example, in the case where the width of the secondary transfer roller 8 is 338 mm and the width of the recording material P acquired in S602 is the width (148.5 mm) corresponding to the width in the A5 short edge feeding, the width of the non-sheet passing portion is 189.5 mm obtained by subtracting the width of the recording material P from the width of the secondary transfer roller 8. Further, it is assumed that the secondary transfer voltage Vtr acquired in S606 is, for example, 1000 V and that from the relationship between the voltage and the current acquired in S605, the current corresponding to the secondary transfer voltage Vtr is 40 μA. In this case, the current flowing through the non-sheet passing portion correspondingly to the above-described secondary transfer voltage Vtr can be acquired from the following calculation:

$$40\ \mu A \times 189.5\ mm / 338\ mm = 22.4\ \mu A.$$

That is, by a proportional calculation such that the current of 40 μA corresponding to the above-described secondary transfer voltage Vtr is made small correspondingly to a ratio of the width of 189.5 mm of the non-sheet passing portion to the width of 338 mm of the secondary transfer roller 8, it is possible to acquire the current flowing through the non-sheet passing portion.

In the case where the thickness of the recording material P is relatively small, the value acquired in S703 can be used as the non-sheet passing portion current. However, as the thickness of the recording material P becomes large, the non-sheet passing portion pressure when the recording material P is present in the secondary transfer portion N2 decreases, whereby the non-sheet passing portion current becomes small. Therefore, in this embodiment, the controller 50 carries out control of correcting the non-sheet passing portion current depending on the thickness of the recording material P (S704). A non-sheet passing portion current before the correction acquired in S703 is Inp_bef, a non-sheet passing portion current after the correction is Inp_aft, and correction coefficient is e (%). At this time, the non-sheet passing portion current can be acquired by the following formula 6.

$$Inp_aft = e * Inp_bef \quad \text{(formula 6)}$$

Figures 18, 19:
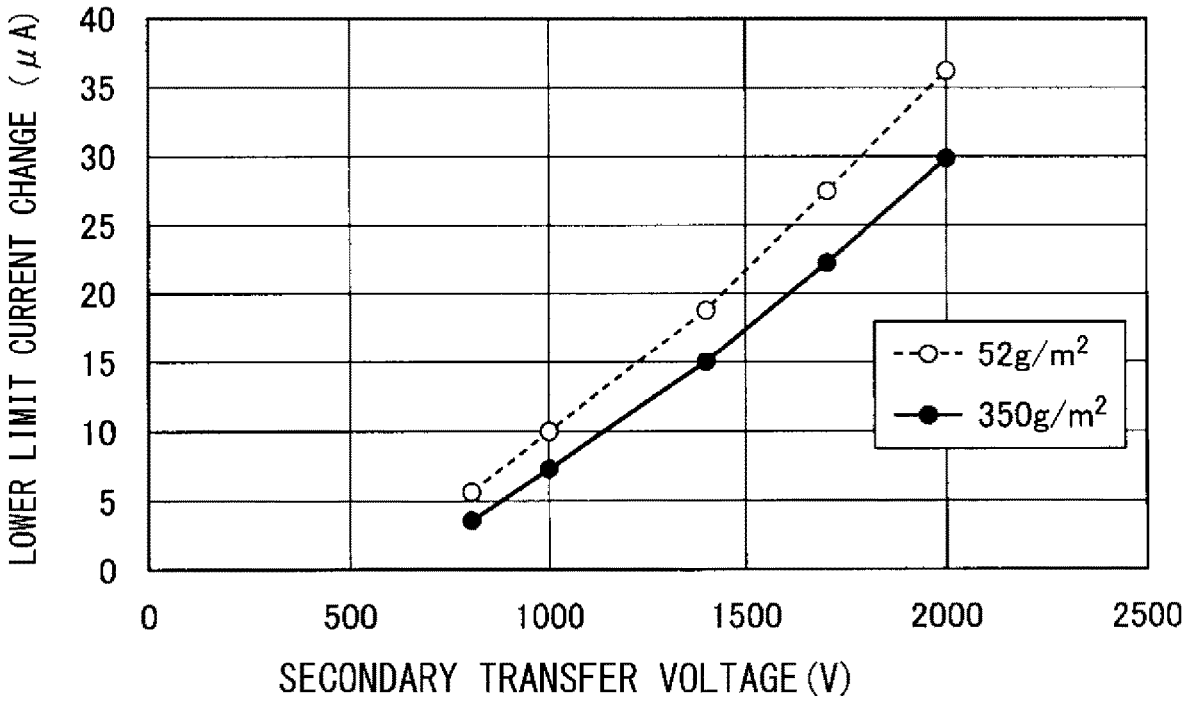
FIG. 18 is a schematic view showing an example of a table data of correction coefficient of a non-sheet passing portion current.
FIG. 19 is a graph for illustrating a change in secondary transfer current range depending on a thickness of a recording material.

Here, in this embodiment, the correction coefficient e in the above formula 6 is determined on the basis of a table data which is acquired by an experiment or the like and is stored in the ROM 53 and which shows a relationship between the width of the recording material P and the correction coefficient e for each of sections of the basis weight of the recording material P as shown in FIG. 18. On the basis of the information, included in the information on the job acquired in S602, on the width of the recording material P and the basis weight of the recording material P, the controller 50 determines the correction coefficient e by making reference to the table data shown in FIG. 18. As the thickness of the recording material P is large, the non-sheet passing portion pressure becomes low. In consideration of this, the correction coefficient e is set so that as the thickness of the recording material P is large, the non-sheet passing portion current after the correction becomes small. Further, as the width of the recording material P is large, the intermediary transfer belt 7 and the secondary transfer roller 8 at the non-sheet passing portion do not readily contact each other, so that the non-sheet passing portion pressure becomes low. In consideration of this, the correction coefficient e is set so that as the width of the recording material P is large, the non-sheet passing portion current after the correction becomes small. For example, in the case where the width of the recording material P corresponds to A5 short edge feeding (148.5 mm) and the basis weight of the recording material P is 350 g/m$^2$, 85% of the non-sheet passing portion current Inp_bef before the correction is the non-sheet passing portion current Inp_aft after the correction. On the other hand, for example, in the case where the width of the recording material P corresponds to the A5 short edge feeding (148.5 mm) similar to the above and the basis weight of the recording material P is 52 g/m$^2$, the non-sheet passing portion current which is kept at 100% of the non-sheet passing portion current Inp_bef before the correction is the non-sheet passing portion current Inp_aft after the correction.

Next, the controller 50 acquires the upper limit and the lower limit ("secondary transfer current range") of the secondary transfer current when the recording material P passes through the secondary transfer portion N2 in the following manner, and causes the RAM 52 to store the acquired secondary transfer current range (S705). That is, the controller 50 acquires the upper limit and the lower limit (the "secondary transfer current range") of the secondary transfer current when the recording material P passes through the secondary transfer portion N2 by adding the non-sheet passing portion current after the correction acquired in S704 to each of the upper limit and the lower limit of the sheet passing portion current acquired in the S702. That is, the upper limit of the secondary transfer current when the recording material P passes through the secondary transfer portion N2 is I_max, and the lower limit thereof is I_min. At this time, the upper limit and the lower limit of the secondary transfer current can be acquired by the following formulas 7 and 8, respectively.

$$I_\text{max}=Ip_\text{max_aft}+Inp_\text{aft} \quad \text{(formula 7)}$$

$$I_\text{min}=Ip_\text{min_aft}+I_{np}\text{-aft} \quad \text{(formula 8)}$$

For example, the case where the range of the current which may be passed through the sheet passing portion corresponding to the A4 size corresponding width acquired in S701 is 20 μA in upper limit and 15 μA in lower limit will be considered. In this case, when the width of the recording material P actually used in the image formation is the width corresponding to the width in the short edge feeding, the upper limit of the range of the current which may be passed through the sheet passing portion is 10 μA, and the lower limit of the range of the current which may be passed through the sheet passing portion is 7.5 μA. Then, when the current flowing through the non-sheet passing portion acquired in S703 is 22.4 μA as in the above-described example, in the case where the recording material P is thick paper corresponding to the basis weight of 350 g/m$^2$, 19 μA obtained by correcting the above-described 22.4 μA to 85% thereof is the non-sheet passing portion current after the correction. In the case, the upper limit of the secondary transfer current range is 29 μA and the lower limit of the secondary transfer current range is 26.5 μA. On the other hand, when the current acquired in S703 and flowing through the non-sheet passing portion is 22.4 μA similar to the above, in the case where the recording material P is paper of the basis weight of 52 g/m$^2$, the non-sheet passing portion current after the correction is kept at 22.4 μm which the non-sheet passing portion current before the correction. For that reason, in this case, the upper limit of the secondary transfer current is 32.4 μA, and the lower limit thereof is 29.9 μA.

With reference to part (a) of FIG. 17, next, the controller 50 compares the secondary transfer current value detected by the current detecting circuit 21 and the secondary transfer current range acquired in S607 with each other in a period in which the recording material P exists in the secondary transfer portion N2 from when the recording material P reaches the secondary transfer portion N2 (S608, S609). Then, the controller 50 corrects the secondary transfer voltage Vtr outputted by the secondary transfer voltage source 20, as needed (S610, S611). That is, in the case where the detected secondary transfer current value is a value (not less than the lower limit and not more than the upper limit) of the secondary transfer current range acquired in S607, the controller 50 maintains the secondary transfer voltage Vtr outputted by the secondary transfer voltage source 20 as it is without changing the secondary transfer voltage Vtr (S610). On the other hand, in the case where the detected secondary transfer current value deviates (being less than the lower limit or exceeds the upper limit) from the secondary transfer current range acquired in S607, the controller 50 corrects the secondary transfer voltage Vtr outputted by the secondary transfer voltage source 20 so that the value falls within the secondary transfer current range (S611). In this embodiment, in the case where the secondary transfer current value exceeds the upper limit, the controller 50 lowers the secondary transfer voltage Vtr and stops correction of the secondary transfer voltage Vtr at the time when the secondary transfer current is below the upper limit, and maintains the secondary transfer voltage Vtr at that time. Typically, the secondary transfer voltage Vtr is stepwisely lowered in a predetermined decrement. Further, in this embodiment, in the case where the secondary transfer current value is below the lower limit, the controller 50 increases the secondary transfer voltage Vtr and stops the correction of the secondary transfer voltage Vtr at the time when the secondary transfer current exceeds the lower limit, and maintains the secondary transfer voltage Vtr at that time. Typically, the secondary transfer voltage Vtr is stepwisely increased in a predetermined increment. More specifically, the controller 50 repeats the processes of S608-S611 during passing of the recording material P through the secondary transfer portion N2, and when the secondary transfer current becomes a value of the secondary transfer current range, the controller 50 stops the correction of the secondary transfer voltage Vtr and maintains the secondary transfer voltage Vtr at the secondary transfer voltage Vtr at that time.

Further, the controller 50 repeats the processes of S608-S611 until all the images in the job are completely transferred and outputted (S612).

The change in secondary transfer current range by carrying out the control of this embodiment will be further described. The case where a result of detection of the electric resistance of the secondary transfer portion N2 before the recording material P reaches the secondary transfer portion N2 is the same degree and the secondary transfer voltage necessary during the secondary transfer is the same degree will be considered. At this time, relative to the secondary transfer current range in the case where the recording material P with a maximum width is used, the secondary transfer current range in the case where the recording material P smaller in width than the recording material P with the maximum width shifts to a high level (so that an absolute value of the current becomes large). However, this shift amount becomes small as the thickness of the recording material P becomes large.

For example, the case where each of paper (thin paper) with the basis weight of 52 g/m$^2$ and paper (thick paper) with the basis weight of 350 g/m$^2$ is used as the recording material P will be considered. Further, it is assumed that a result of detection of the electric resistance of the secondary transfer portion N2 before the recording material P reaches the secondary transfer portion N2 is the same degree in either case and that a current of 30 μA flowed under application of 1000 V. At this time, for the paper with the basis weight of 52 g/m$^2$, the secondary transfer current range in the case of the A4 size (width: 297 mm) is 24.9-19.9 μA, but the secondary transfer current range in the case of the A5 short edge feeding size (width: 148.5 mm) is 32.3-29.8 That is, as regards the paper with the basis weight of 52 g/m$^2$, when the width of the recording material P becomes small, the secondary transfer current range shifts to a high level as a whole, so that the secondary transfer current range increases by about 10 μA in terms of the lower limit. On the other hand, for the paper with the basis weight of 350 g/m$^2$, the secondary transfer current range in the case of the A4 size (width: 297 mm) is 24.1-19.1 μA, but the secondary transfer current range in the case of the A4 short edge feeding size (width: 148.5 mm) is 29-26.5 μA. That is, as regards the paper with the basis weight of 350 g/m$^2$, when the width of the recording material P becomes small, the secondary transfer current range shifts to a high level as a whole, but the secondary transfer current range increases only by about 6.5 μA in terms of the lower limit, so that the shift amount becomes small compared with the case of the paper with the basis weight of 52 g/m$^2$.

In actuality, as shown in FIG. 6, the electric resistance is liable to become high as the recording material P has a large through, so that the secondary transfer voltage Vtr necessary during the secondary transfer is liable to become high. For that reason, between the case where the thick paper is used and the case where the thin paper is used, the secondary transfer voltage Vtr necessary during the secondary transfer becomes large in the case where the thick paper is used. When the secondary transfer voltage Vtr is large, the secondary transfer current during the absence of the recording material P in the secondary transfer portion N2 is also large, so that a change amount of the secondary transfer current range in the case where the size of the recording material P changes also becomes large. FIG. 19 is a graph in which a difference between the lower limit of the secondary transfer current range in the case of the A4 short edge feeding size and the lower limit of the secondary transfer current range in the case of the A4 size is plotted in the case where an initial secondary transfer voltage Vtr determined in S606 of part (a) of FIG. 17 is changed in the constitution of this embodiment. A broken line in FIG. 19 is a plot of the case of the paper with the basis weight of 52 g/m$^2$ and a solid line in FIG. 19 is a plot of the case of the paper with the basis weight of 350 g/m$^2$. When the thickness of the recording material P is different, the initial secondary transfer voltage Vtr changes. However, the secondary transfer voltage Vtr is changed to several levels, and when the difference in lower limit of the secondary transfer current range due to the difference in width of the recording material P is plotted, the following result is obtained. That is, the difference in lower limit of the secondary transfer current range due to the difference in width of the recording material P in the case of a certain secondary transfer voltage Vtr becomes small when the recording material P having a large thickness is used, as shown in FIG. 19.

Incidentally, in this embodiment, the information on the electric resistance of the secondary transfer portion N2 in the state in which the recording material P is absent in the secondary transfer portion N2 was acquired by detecting the current flowing when the voltage was actually applied to the secondary transfer portion N2. However, the present invention is not limited to this, but for example, the information for acquiring the electric resistance of the secondary transfer portion N2 from an environmental information such as a relationship between an output value of the environmental sensor 32 and the electric resistance of the secondary transfer portion N2 can be prepared as the table data or the like in advance. Then, on the basis of the output value of the environmental sensor 32, by making reference to the table data or the like, the electric resistance of the secondary transfer portion N2 can be acquired.

Thus, in this embodiment, the controller 50 changes the above-described predetermined range on the basis of the detection result detected by the detecting portion 21 when the voltage is applied to the transfer member 8 in the state in which the recording material P is absent in the transfer portion N2, and the information on the thickness of the recording material P passing through the transfer portion N2. Here, the recording materials P onto which the toner images are capable of being transferred at the transfer portion N2, the width of the recording material P in which the width with respect to the direction substantially perpendicular to the feeding direction of the recording material P is maximum is a maximum width. At this time, in this embodiment, in the case where the electric resistance indicated by the detection result detected by the detecting portion 21 when the voltage is applied to the transfer member 8 in the state in which the recording material P is absent in the transfer portion N2, the controller 50 is capable of changing an absolute value of the upper limit of the predetermined range in the following manner on the basis of the width of the recording material P passing through the transfer portion N2. That is, the controller 50 changes the upper limit of the predetermined range so that in the case where the thickness of the recording material P passing through the transfer portion N2 is the first thickness, a change amount of the upper limit of the predetermined range to a change, from the maximum width, of the recording material P passing through the transfer portion N2 is a first amount and so that in the case where the thickness of the recording material P passing through the transfer portion N2 is the second thickness larger than the first thickness, the change amount of the upper limit of the predetermined range is a second amount smaller than the first amount.

In other words, in this embodiment, the controller 50 changes the predetermined range in the following manner. That is, in the case where the electric resistance indicated by the detection result detected by the detecting portion 21 when the voltage is applied to the transfer member 8 in the state in which the recording material P is absent in the transfer portion N2 is a predetermined electric resistance and the thickness of the recording material P passing through the transfer portion N2 is the first thickness (for example, the thin paper of 52 g/m$^2$ in basis weight in the above-described example), the controller 50 sets the predetermined range at a first predetermined range (for example, 24.9-19.9 μA in the above-described example) in a case that the width of the recording material P with respect to the direction substantially perpendicular to the feeding direction of the recording material P is a first width (for example, the A4 size corresponding width in the above-described example) and sets the predetermined range at a second predetermined range (for example, 32.3-29.8 μA in the above-described example) in a case that the width of the recording material P is a second width (for example, the A5 short edge feeding size corresponding width in the above-described example) smaller than the first width. At this time, in this embodiment, the absolute value of the upper limit of the second predetermined range is larger than the absolute value of the upper limit of the first predetermined pass. Further, in this embodiment, the absolute value of the lower limit of the second predetermined range is larger than the absolute value of the lower limit of the first predetermined range.

Further, in the case where the electric resistance indicated by the detection result detected by the detecting portion 21 when the voltage is applied to the transfer member 8 in the state in which the recording material P is absent in the transfer portion N2 is a predetermined electric resistance and the thickness of the recording material P passing through the transfer portion N2 is the second thickness (for example, the thick paper of 350 g/m$^2$ in basis weight in the above-described example) larger than the first thickness, the controller 50 sets the predetermined range at a third predetermined range (for example, 24.1-19.1 μA in the above-described example) in a case that the width of the recording material P is the first width and sets the predetermined range at a second predetermined range (for example, 29-26.5 μA in the above-described example) in a case that the width of the recording material P is a fourth width smaller than the third width. At this time, in this embodiment, the absolute value of the upper limit of the fourth predetermined range is larger than the absolute value of the upper limit of the third predetermined pass. Further, in this embodiment, the absolute value of the lower limit of the fourth predetermined range is larger than the absolute value of the lower limit of the third predetermined range. Further, in this embodiment, a difference (for example, 4.9 μA (=29−24.1) in the above-described example) in absolute value of the upper limit between the third predetermined range and the fourth predetermined range is smaller than a difference (for example, 7.4 μA (=32.3−24.9) in the above-described example) in absolute value of the upper limit between the first predetermined range and the second predetermined range. Further, in this embodiment, a difference (for example, 7.4 μA (=26.5−19.1) in the above-described example) in absolute value of the lower limit between the third predetermined range and the fourth predetermined range is smaller than a difference (for example, 9.9 μA (=29.8−19.9) in the above-described example) in absolute value of the upper limit between the first predetermined range and the second predetermined range.

Further, in this embodiment, the image forming apparatus 100 includes the storing portion 53 for storing pieces of information on the above-described predetermined ranges depending on the recording materials P. Further, in this embodiment, the controller 50 changes the predetermined range on the basis of the detection result detected by the detecting portion 21 when the voltage is applied to the transfer member 8 in the state in which the recording material P is absent in the transfer portion N2, the information on the thickness of the recording material P passing through the transfer portion N2 and the information on the predetermined range stored in the storing portion 53. Further, in this embodiment, the controller 50 acquires the voltage-current characteristic, which is the relationship between the voltage when the voltage is applied to the transfer member 8 and the current flowing through the transfer member 8, on the basis of a detection result of the detecting portion 21 when different voltages or currents of three levels or more are supplied from the voltage source to the transfer portion N2 in the state in which the recording material P is absent in the transfer portion N2, and on the basis of this voltage-current characteristic, the controller 50 acquires the current flowing through the transfer member 8 in the case where the predetermined voltage is applied to the transfer member 8 in the state in which the recording material P is absent in the transfer portion N2, and changes the predetermined range on the basis of the acquired current. Further, in this embodiment, this voltage-current characteristic is represented by a polynomial expression of a quadratic or higher degree.

As described above, in this embodiment, the current flowing through the non-sheet passing portion when the recording material P passes through the secondary transfer portion N2 is predicted by acquiring the information on the electric resistance of the secondary transfer portion N2 before the recording material P reaches the secondary transfer portion N2. At this time, not only the predicted value of the current flowing through the non-sheet passing portion is changed on the basis of the information on the width of the recording material, but also the predicted value is corrected on the basis of the information on the thickness of the recording material P. More specifically, the correction is made so that the output flowing through the non-sheet passing portion becomes small as the thickness of the recording material P becomes large. By this, it becomes possible to accurately predict the current flowing through the non-sheet passing portion. Then, by adding the predicted current flowing through the non-sheet passing portion and the range of the current which may be passed through the sheet passing portion to each other from a viewpoint of suppression of the image defect, the secondary transfer current range when the recording material P passes through the secondary transfer portion N2 is determined. Further, the secondary transfer voltage when the recording material P passes through the secondary transfer portion N2 is controlled so as to become a value of the secondary transfer current range thereof. By this, even in the case where the recording material P such as the thick paper with a relatively large through is used, it becomes possible to output a proper image irrespective of the electric resistances of the secondary transfer portion N2 (principally the secondary transfer roller 8 in this embodiment) and the recording material P which fluctuate in various situations.

Embodiment 6

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In the embodiment 5, by making reference to FIG. 18, the correction of the non-sheet passing portion current based on the thickness of the recording material P was made. Here, the case where the change in non-sheet passing portion current due to the difference in thickness of the recording material P can be remarkably confirmed is the case where the index value relating to the thickness of the recording material P is not less than the predetermined threshold (for example, the case where the basis weight is not less than a predetermined through). For that reason, for example, only in the case where the basis weight of the recording material P is not less than the predetermined basis weight, it is possible to correct the non-sheet passing portion current in the process of S704 of part (b) of FIG. 17. In this embodiment, only in the case where the basis weight of the recording material P is not less than the predetermined basis weight larger than the basis weight in the case of the embodiment 5, the non-sheet passing portion current is corrected by the process of S704 of part (b) of FIG. 17.

That is, in this embodiment, the table data used in the process of S704 of part (b) of FIG. 17 is changed from the table data of FIG. 18 in the embodiment 5 to a table data of FIG. 20. In the table data of FIG. 20, in the case where the basis weight of the recording material P is less than 200 $g/m^2$, the correction coefficient e is set at 100%. For that reason, in this embodiment, the correction of the non-sheet passing portion current in the process of S704 of part (b) of FIG. 17 is not made in the case where the basis weight of the recording material P is less than 200 $g/m^2$, and is made only in the case where the basis weight of the recording material P is less than 200 $g/m^2$.

Thus, in the case where the thickness of the recording material P passing through the transfer portion N2 is not less than the predetermined thickness, the controller 50 is capable of changing the secondary transfer current range (predetermined range) based on the thickness of the recording material P passing through the transfer portion N2.

As described above, in this embodiment, only in the case where the recording material P with the thickness in which the change in non-sheet passing portion current becomes particularly conspicuous, the correction of the predicted value of the non-sheet passing portion current based on the detection result of the electric resistance of the secondary transfer portion and the width of the recording material P is made. By this not only an effect similar to the effect of the embodiment 5, but also simplification of the control can be realized.

Embodiment 7

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In this embodiment, in a constitution in which the current passed through the sheet passing portion is controlled to the substantially certain value at the target current, similarly as in the embodiment 5, the electric resistance of the secondary transfer portion N2 is detected before the recording material P reaches the secondary transfer portion N2. Further, on the basis of the detection result thereof and the information on the width of the recording material P, not only the predicted value of the non-sheet passing portion current when the recording material P passes through the secondary transfer portion N2 is acquired, but also the predicted value is corrected on the basis of the information on the thickness of the recording material P. By this, a target value ("secondary transfer current target value") of the secondary transfer current when the recording material P passes through the secondary transfer portion N2 is acquired.

Figure 21:
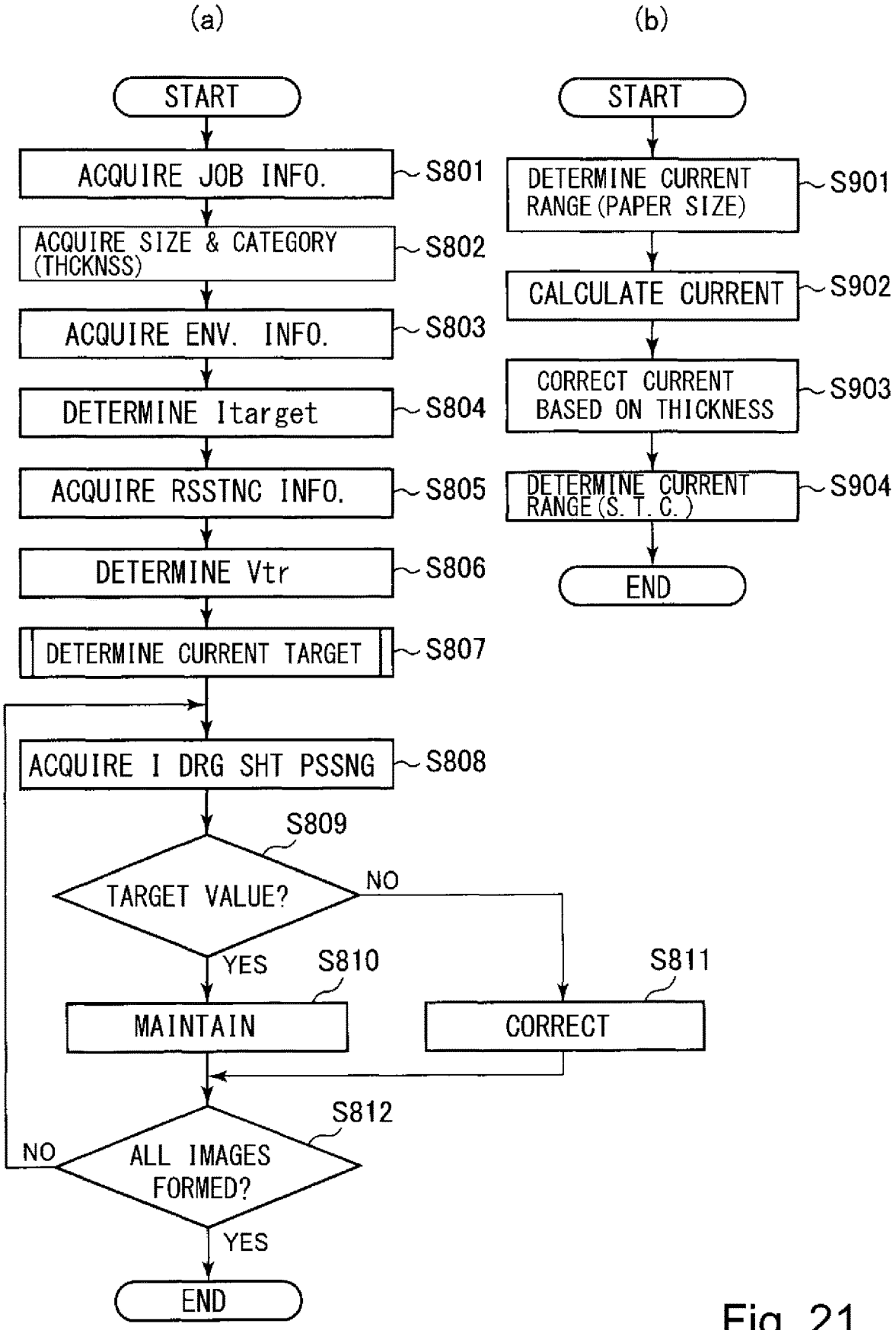
FIG. 21 includes flowcharts of control in an embodiment 7.

FIG. 21 includes flowcharts showing an outline of a procedure of control of the secondary transfer voltage in this embodiment. Processes of S801 to S812 of part (a) of FIG. 21 are similar to S601 to S612, respectively, of part (a) of FIG. 17 in the embodiment 5. However, in this embodiment, the process (process for determining the secondary transfer current target value) of S807 of part (a) of FIG. 21 corresponding to the process (process for determining the secondary transfer current range) of S607 of part (a) of FIG. 17 in the embodiment 5 is different from the process in the embodiment 5. Further, in this embodiment, the process (process for comparing the secondary transfer current with the secondary transfer current target value) of S809 of part (a) of FIG. 21 corresponding to the process (process for comparing the secondary transfer current with the secondary transfer current range) of S609 of part (a) of FIG. 17 in the embodiment 5 is different from the process in the embodiment 5. Part (b) of FIG. 21 shows a procedure of the process for determining the secondary transfer current target value in S807 of part (a) of FIG. 21. In the following, a point different from particularly the embodiment 5 will be described, and description about the processes similar to those of the embodiment 5 will be omitted.

In this embodiment, in the ROM 53, as shown in FIG. 9, information for acquiring a value "(sheet passing portion current (passing portion current)" of a current which may be passed through the secondary transfer portion N2 when the recording material P passes through the secondary transfer portion N2, from the viewpoint of suppression of the image defect is stored. In this embodiment, this information is set as a table data showing a relationship between the ambient water content and the current which may be passed through the sheet passing portion. Incidentally, the range of the current which may be passed through the sheet passing portion changes depending on the width of the recording material P. In this embodiment, the above-described table data is set on the assumption that the recording material P is a recording material of 297 mm in width corresponding to an A4 size. Further, in this embodiment, the width of the secondary transfer portion N2 is 338 mm corresponding to the secondary transfer roller 8. Accordingly, the target current Itarget in the state in which the recording material P is absent is a value which is 338/297 (≈1.14 time) the value of the current shown in a table data of FIG. 9. In this embodiment, in S804 of part (a) of FIG. 21, by making reference to the table data shown in this FIG. 9, the target control value Itarget is acquired and is written in the RAM 52.

Here, from the view point of suppressing the image defect the current value which may be passed through the sheet passing portion changes in some instances also depending on a thickness and a surface property of the recording material P as a factor other than the environmental information. For that reason, the table data may also be set so that the current value changes also depending on information (basis weight) relating to the thickness of the recording material P or information relating to the surface property of the recording material P. The current value which may be passed through the sheet passing portion may also be set as a calculation formula. Further, the current value which may be passed through the sheet passing portion may also be set as a plurality of table data or calculation formulas for each of sizes of the recording materials P. Further, as described in the embodiment 5, the reason why the target current Itarget is changed depending on the environmental information is that the toner charge amount changes depending on the environment. For that reason, similarly as described in the embodiment 5, the target current Itarget may also be changed depending on another change mode.

By making reference to part (a) of FIG. 21, the controller 50 performs the process of determining the target value ("secondary transfer current target value") of the secondary transfer current when the recording material P passes through the secondary transfer portion N2 (S807). By making reference to part (b) of FIG. 21, on the basis of the information on the width of the recording material P, included in the information on the job, acquired in S802, the controller 50 corrects the current value (acquires the target current Itarget from this current value in S804), acquired in S804, which may be passed through the sheet passing portion (S901). The current value acquired in S804 meets the width (297 mm) corresponding to the A4 size. For example, in the case where the width of the recording material P actually used in the image formation is a width (148.5 mm) corresponding to a width in A5 short edge feeding, i.e., in the case where the width is ½ of the width corresponding to the A4 size, the current range is corrected to a current range proportional to the width of the recording material P so that the current value acquired in S804 becomes ½ thereof. That is, the sheet passing portion current before the correction acquired from the table data of FIG. 9 is Ip_Tg, the width of the recording material P when the table of FIG. 9 is determined is Lp_bas, the width of the recording material P actually fed is Lp, and the sheet passing portion current after the correction is Ip_Tag_aft. At this time, the sheet passing portion current after the correction can be acquired by the following formula 9.

$$Ip_tag_aft = Lp/Lp_bas * Ip_tag \quad \text{(formula 9)}$$

Next, the controller 50 acquires the current flowing through the non-sheet passing portion on the basis of the following pieces of information (S902). The pieces of information are the information on the width of the recording material P, included in the information on the job, acquired in S802, the information on the relationship, acquired in S805, between the voltage and the current of the secondary transfer portion N2 in the state in which the recording material P is absent in the secondary transfer portion N2, and the information on the secondary transfer voltage Vtr (=Vb+Vp) acquired in S806. That is, similarly as in the embodiment 5, on the basis of the target current Itarget written in the RAM 52 is S804 and the relationship between the voltage and the current acquired in S805, the controller 50 acquires the voltage value Vb necessary to cause the target current Itarget through the secondary transfer portion N2 in the state in which the recording material P is absent in the secondary transfer portion N2. Further, the controller 50 acquires Vp similarly as in the embodiment 5. The process of S902 of part (b) of FIG. 21 is similar to the process of S703 of part (b) of FIG. 17 in the embodiment 5.

Next, similarly as in the embodiment 5, the controller 50 carries out control of correcting the non-sheet passing portion current depending on the thickness of the recording material P (S903). The non-sheet passing portion current before the correction acquired in S902 is Inp_bef, the non-sheet passing portion current after the correction is Inp_aft, and the correction coefficient is e (%). At this time, the non-sheet passing portion current after the correction can be acquired by the following formula 7 similar to that in the embodiment 5.

$$Inp_aft = e * Inp_bef \quad \text{(formula 6)}$$

Here, in this embodiment, the correction coefficient e in the formula 6 is determined on the basis of the table data as shown in FIG. 18 similar to that in the embodiment 5.

Next, the controller 50 acquires the secondary transfer current target value when the recording material P passes through the secondary transfer portion N2 in the following manner, and causes the RAM 52 to store the acquired secondary transfer current target value (S904). That is, the controller 50 acquires secondary transfer current target value when the recording material P passes through the secondary transfer portion N2 by adding the non-sheet passing portion current acquired in S902 to the sheet passing portion current acquired in the S901. That is, the secondary transfer current target value Itarget_aft can be acquired by the following formula 10.

$$Itarget_aft = Ip_tag_aft + Inp_aft \quad \text{(formula 10)}$$

For example, the case where the value of the current which may be passed through the sheet passing portion corresponding to the A4 size corresponding width acquired in S804 is 18 μA will be considered. In this case, when the width of the recording material P actually used in the image formation is the width corresponding to the width in the short edge feeding, the value of the current which may be passed through the sheet passing portion is 9 μA. Then, when the current flowing through the non-sheet passing portion acquired in S902 is 22.4 μA similarly as in the example described in the embodiment 5, in the case where the recording material P is the thick paper corresponding to the basis weight of 350 g/m$^2$, 19 μA which is obtained by correcting the above-described 22.4 μA to 85% thereof is the non-sheet passing portion current after the correction. In this case, the secondary transfer current target value is 28 (=9+19) μA. On the other hand, when the current flowing through the non-sheet passing portion acquired in S902 is 22.4 μA similarly as described above, in the case where the recording material P is the paper with the basis weight of 52 g/m$^2$, the non-sheet passing portion current after the correction is kept at 22.4 μA which is the non-sheet passing portion current before the correction. For that reason, in this case, the secondary transfer current target value is 31.4 (=9+22.4) μA.

With reference to part (a) of FIG. 21, next, the controller 50 compares the secondary transfer current value detected by the current detecting circuit 21 and the secondary transfer current target value acquired in S904 with each other in a period in which the recording material P exists in the secondary transfer portion N2 (S808, S809). Then, the controller 50 corrects the secondary transfer voltage Vtr outputted by the secondary transfer voltage source 20, as needed (S810, S811). Here, in this embodiment, in a predetermined period (initial stage) from when the recording material P reaches the secondary transfer portion N2, the secondary transfer voltage Vtr determined in S806 is applied. This is because in the case of a system in which the electric resistance largely fluctuates depending on the presence or absence of the recording material P, when the voltage is intended to be applied under constant-current control from the state in which the recording material P is absent, the voltage value largely fluctuates and the flowing current rather becomes unstable. For that reason, in this embodiment, in an initial stage of the period in which the recording material P passes through the secondary transfer portion N2, a certain voltage was applied. Then, from after a lapse of a predetermined period (for example a period until a leading end marginal portion of the recording material P completely passes through the secondary transfer portion N2) after a leading end of the recording material P with respect to the feeding direction enters the secondary transfer portion N2, the voltage was applied so that the secondary transfer current value becomes a certain current value. In the case where the detected secondary transfer current value is a substantially identical to (may also be different within an allowable control error range from) the secondary transfer current target value acquired in S904, the controller 50 maintains the secondary transfer voltage Vtr outputted by the secondary transfer voltage source 20 as it is without changing the secondary transfer voltage Vtr (S810). On the other hand, in the case where the detected secondary transfer current value deviates from the secondary transfer current target value acquired in S904, the controller 50 corrects the secondary transfer voltage Vtr outputted by the secondary transfer voltage source 20 so that the value falls within the secondary transfer current target value (S811). In this embodiment, the controller 50 stops correction of the secondary transfer voltage Vtr at the time when the secondary transfer current value is substantially identical to the secondary transfer current target value, and maintains the secondary transfer voltage Vtr at that time.

Thus, in this embodiment, the controller 50 carries out the constant-current control of the voltage applied to the transfer member 8 so that the current flowing through the transfer member 8 when the recording material P passes through the transfer portion N2 becomes a predetermined current. Then, in this embodiment, the controller 50 changes the predetermined current on the basis of the detection result detected by the detecting portion 21 when the voltage is applied to the transfer member 8 in the state in which the recording material P is absent in the transfer portion N2 and the information on the thickness of the recording material P passing through the transfer portion N2. At this time, of the period in which the recording material P passes through the transfer portion N2, in a first period in which a predetermined leading end portion of the recording material P passes through the transfer portion N2, the controller 50 carries out the constant-voltage control of the voltage applied to the transfer member 8 so that the predetermined voltage is applied to the transfer member 8. Further, in a second period subsequent to the first period, the controller 50 carried out the constant-current control.

As described above, in this embodiment, similarly as in the embodiment 5, the current flowing through the non-sheet passing portion can be accurately predicted. Then, in this embodiment, by adding the predicted current flowing through the non-sheet passing portion and the value of the current which may be passed through the sheet passing portion to each other from a viewpoint of suppression of the image defect, the secondary transfer current target value when the recording material P passes through the secondary transfer portion N2 is determined. Further, the secondary transfer voltage when the recording material P passes through the secondary transfer portion N2 is controlled so as to become the secondary transfer current target value thereof. By this, even in the case where the recording material such as the thick paper with a relatively large thickness is used, it becomes possible to output a proper image irrespective of the electric resistances of the secondary transfer portion N2 (principally the secondary transfer roller 8 in this embodiment) and the recording material P which fluctuate in various situations.

Embodiment 8

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In the embodiments 5 to 7, the secondary transfer current range (or the secondary transfer current target value) obtained by adding the range ("sheet passing portion current range") of the current which may be passed through the sheet passing portion when the recording material P passes through the secondary transfer portion N2 and the predicted value (after the correction due to the thickness of the recording material P) of the non-sheet passing portion current was acquired. Then, the secondary transfer voltage was controlled so that the secondary transfer current measured during the secondary transfer becomes the secondary transfer current range value (or the secondary transfer current target value) thereof. On the other hand, the sheet passing portion current is acquired by subtracting the predicted value (after the correction due to the thickness of the recording material P) of the non-sheet passing portion current, and the secondary transfer voltage may also be controlled so that the acquired sheet passing portion current becomes a predetermined sheet passing portion current range value.

Figure 22:
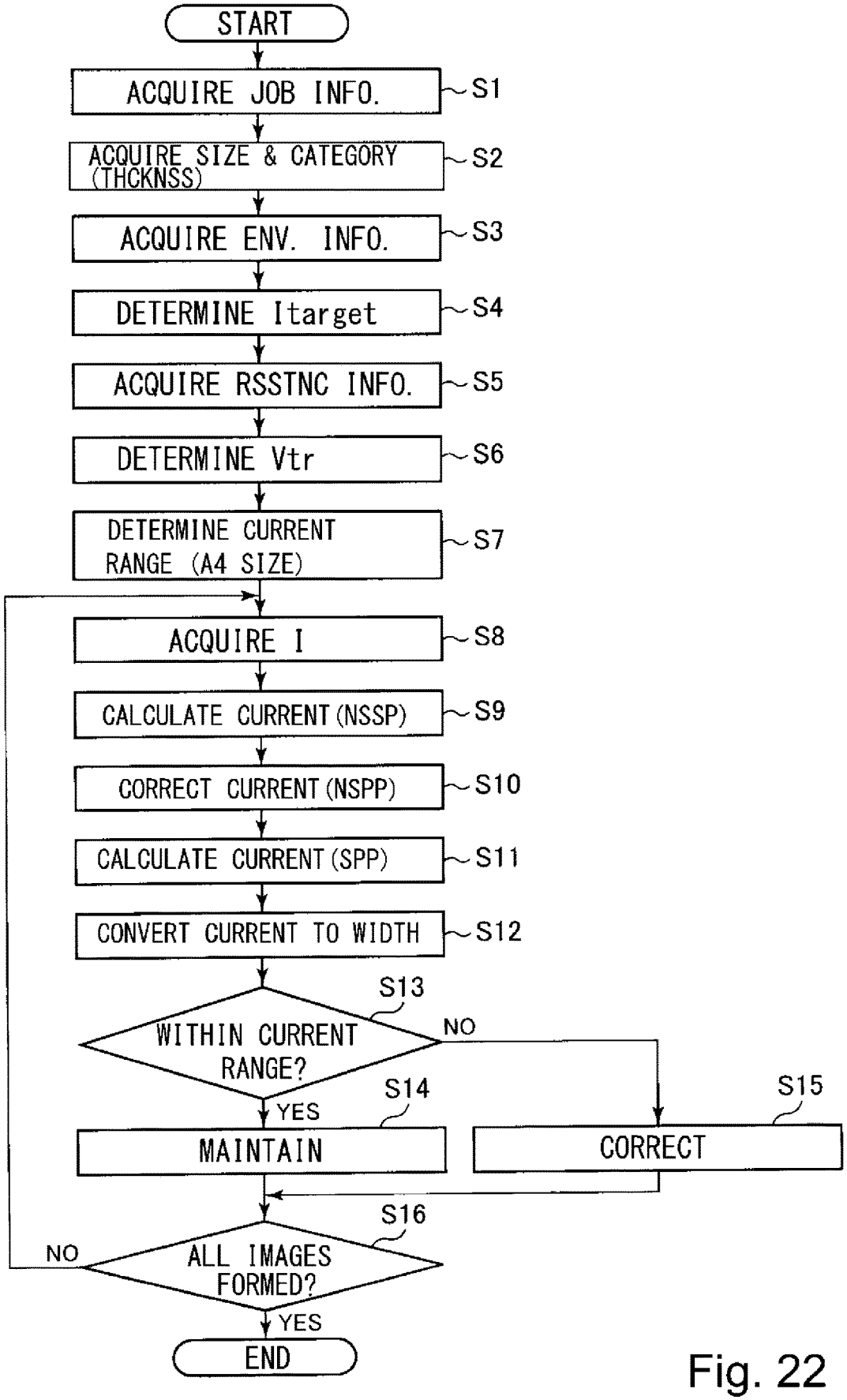
FIG. 22 is a flowchart of control in an embodiment 8.

FIG. 22 is a flowchart showing an outline of procedure of control of the secondary transfer voltage in this embodiment. Process of S1 to S6 of FIG. 22 are similar to the processes of S601 to S606, respectively, of part (a) of FIG. 17 in the embodiment 5. Further, a process of S7 of FIG. 22 is similar to the process of S701 of part (b) of FIG. 17 in the embodiment 1. In the following, particularly a point different from the embodiment 5 will be described, and description about the processes similar to those of the embodiment 5 will be omitted.

The controller 50 acquires, in S7, the sheet passing portion current range corresponding to the A4 size similarly as the process of S701 of part (b) of FIG. 17 in the embodiment 5. Thereafter, in a period in which the recording material P is present in the secondary transfer portion N2 from when the recording material P reaches the secondary transfer portion N2, the controller 50 detects, by the current detecting circuit 21, the secondary transfer current when the secondary transfer voltage Vtr is applied (S8).

Then, the controller 50 acquires the current flowing through the non-sheet passing portion on the basis of the following pieces of information (S9). The pieces of information are the information on the width of the recording material P, included in the information on the job, acquired in S2, the information on the relationship, acquired in S5, between the voltage and the current of the secondary transfer portion N2 in the state in which the recording material P is absent in the secondary transfer portion N2, and the information on the secondary transfer voltage Vtr applied currently. A process of acquiring the non-sheet passing portion current in S9 is similar to the process of S703 of part (b) of FIG. 17 in the embodiment 5. However, in S9, as the secondary transfer voltage Vtr, the secondary transfer voltage (of which initial value is acquired in S6) applied currently is used. That is, the secondary transfer voltage Vtr used for acquiring the current flowing through the non-sheet passing portion in S9 is an initial value acquired in S6 at timing when a first recording material P of the job enters the secondary transfer portion N2. Thereafter, in the case where the secondary transfer voltage Vtr is changed in the following flow, the current flowing through the non-sheet passing portion is acquired by using the changed secondary transfer voltage Vtr.

Next, similarly as in the process of S704 of part (b) of FIG. 17 in the embodiment 5, the controller 50 carries out control of correcting the non-sheet passing portion current depending on the thickness of the recording material P (S10). The non-sheet passing portion current before the correction acquired in S2 is Inp_bef, the non-sheet passing portion current after the correction is Inp_aft, and the correction coefficient is e (%). At this time, the non-sheet passing portion current after the correction can be acquired by the following formula 7 similar to that in the embodiment 5.

$$Inp_aft = e * Inp_bef \quad \text{(formula 6)}$$

Here, in this embodiment, the correction coefficient e in the formula 6 is determined on the basis of the table data as shown in FIG. 18 similar to that in the embodiment 5.

Next, the controller 50 calculates, as the sheet passing portion current, a current obtained by subtracting the non-sheet passing portion current after the correction acquired in S10 from the secondary transfer current detected in S8 (S11). That is, when the secondary transfer current is Itr and the sheet passing portion current is Ip, the sheet passing portion current can be acquired by the following formula 11.

$$Ip = Itr_Inp_aft \quad \text{(formula 11)}$$

The sheet passing portion current Ip applied by the formula 11 is a current value corresponding to the width of the recording material P actually fed, whereas the sheet passing portion current range acquired in S7 in a range corresponding to the width corresponding to a size (A4 size in this embodiment) of the recording material P which is a reference size. For that reason, in this embodiment, the controller 50 performs a process in which the sheet passing to portion current Ip acquired by the formula 11 is converted into a current value corresponding to the width corresponding to the reference size of the recording material P (S12). The width of the recording material P when the table data of FIG. 7 is determined is Lp_bas, the width of the recording material P actually fed is Lp, and the sheet passing portion current after the conversion is Ip_aft. At this time, the sheet passing portion current after the conversion can be acquired by the following formula 12.

$$Ip_aft = Lp_bas / Lp * Ip \quad \text{(formula 12)}$$

Next, the controller 50 compares the sheet passing portion current Ip_aft after the conversion acquired in S12 with the sheet passing portion current range acquired in S7 (S13). Then, the controller 50 corrects the secondary transfer voltage Vtr outputted by the secondary transfer voltage source 20 as needed (S14, S15). That is, in the case where the sheet passing portion current Ip_aft after the conversion is a value (the lower limit or more and the upper limit or less) of the sheet passing portion current range acquired in S7, the controller 50 maintains the secondary transfer voltage Vtr outputted by the secondary transfer voltage source 20 as it is without changing the secondary transfer voltage Vtr (S14). On the other hand, in the case where the sheet passing portion current Ip_aft after the conversion deviates from (is less than the lower limit or exceeds the upper limit) the sheet passing portion current range acquired in S7, the controller 50 corrects the secondary transfer voltage Vtr outputted by the secondary transfer voltage source 20 so that the sheet passing portion current becomes the value of the sheet passing portion current range (S15). That is, in the case where the sheet passing portion current Ip_aft after the conversion exceeds the upper limit of the sheet passing portion current range, the secondary transfer voltage Vtr is lowered. Then, at the time when the sheet passing portion current is below the upper limit, the correction of the secondary transfer voltage Vtr is stopped, and the Vtr at that time is maintained. Typically, the secondary transfer voltage Vtr is stepwisely lowered in a predetermined decrement. Further, in the case where the sheet passing portion current Ip_aft after the conversion is below the lower limit of the sheet passing portion current range, the secondary transfer voltage Vtr is increased. Then, at the time when the sheet passing portion current exceeds the lower limit, the correction of the secondary transfer voltage Vtr is stopped, and the Vtr at that time is maintained. More specifically, in this embodiment, the controller 50 returns the process to S8 in the case where during passing the recording material P through the secondary transfer portion N2, the controller 50 changes the secondary transfer voltage Vtr is S15. Then, a flow (S8 to S12) for acquiring the sheet passing portion current Ip_aft after the conversion relative to the changed secondary transfer voltage Vtr is carried out. Then, this flow is repetitively carried out until the sheet passing portion current Ip_aft after the conversion becomes the value of the sheet passing portion current range acquired in S7. Then, at the time when the sheet passing portion current falls within the value of the sheet passing portion current range, the correction of the secondary transfer voltage Vtr is stopped, and the Utr at that time is maintained.

Further, the controller 50 repeats the processes of S8 to S15 until all the images of the job are transferred onto the recording material P and are completely outputted (S16).

Incidentally, in the case where constant-current control of the secondary transfer voltage Vtr is carried out as in the embodiment 7, it is also possible to apply control based on the sheet passing portion current obtained by subtracting the predicted value of the non-sheet passing portion current from the measured value of the secondary transfer current as in this embodiment. In this case, it may only be required that the sheet passing portion target current value is determined by the process corresponding to S7 in this embodiment and that whether or not the sheet passing portion current coincides with the target value in the process corresponding to S13 in this embodiment.

As described above, in this embodiment, similarly as in the embodiment 5, the current flowing through the non-sheet passing portion can be accurately predicted. Then, in this embodiment, by subtracting the predicted current flowing through the non-sheet passing portion from the measured secondary transfer current, the sheet passing portion current which should be controlled can be accurately acquired. Further, the secondary transfer voltage when the recording material P passes through the secondary transfer portion N2 is controlled that this sheet passing portion current value becomes a value of a predetermined sheet passing portion current range. By this, even in the case where the recording material P such as the thick paper with a relatively large thickness is used, it becomes possible to output a proper image irrespective of the electric resistances of the secondary transfer portion N2 (principally the secondary transfer roller 8 in this embodiment) and the recording material P which fluctuate in various situations.

OTHER EMBODIMENTS

The present invention was described above based on the specific embodiments, but is not limited thereto.

In the above-described embodiments, the recording material was fed on the basis of the center (line) of the transfer member with respect to the direction substantially perpendicular to the feeding direction, but the present invention is not limited thereto, and for example, a constitution in which the recording material is fed on the basis of one end portion side may also be employed, and the present invention can be applied equivalently.

Further, the present invention is also similarly applicable to a monochromatic image forming apparatus including only one image forming portion. In this case, the present invention is applied to a transfer portion where the toner image is transferred from the image bearing member such as the photosensitive drum onto the recording material.

INDUSTRIAL APPLICABILITY

According to the present invention, there is provided the image forming apparatus capable of setting an allowable range of the current, flowing through the transfer member, depending on the fluctuation in electric resistance of the transfer member.

The present invention is not limited to the above-described embodiments, but can be variously changed and modified without departing from the spirit and the scope of the present invention. Accordingly, the following claims are attached for making the scope of the present invention public.

The present application claims priority on the basis of Japanese Patent Application Nos. 2018-101059 filed on May 25, 2018 and 2018-194691 filed on Oct. 15, 2018, which are hereby incorporated by reference herein in their entirety.

The invention claimed is:

1. An image forming apparatus comprising:

an image bearing member configured to bear a toner image;

an intermediary transfer belt onto which the toner image is transferred from said image bearing member;

a transfer member, to which a voltage is applied, configured to transfer the toner image from said intermediary transfer belt onto a recording material in a transfer portion;

a voltage source configured to apply the voltage to said transfer member;

a current detecting portion configured to detect a current flowing though said transfer member; and a controller configured to perform constant-voltage control so that the voltage applied to said transfer member becomes a target voltage in a case in which a detection result detected by said current detecting portion is within a predetermined range determined based on the type of the recording material while the recording material is passing through the transfer portion, wherein in a case in which the detection result is out of the predetermined range while the recording material is passing through the transfer portion, said controller is configured to adjust the target voltage so that the detection result falls within the predetermined range, and perform the constant voltage control with the adjusted target voltage, and wherein said controller sets an upper limit and a lower limit of the predetermined range on the basis of a current flowing through said transfer member when the voltage is applied to said transfer member or a voltage applied to said transfer member when a current is supplied to said transfer member, in a state in which the recording material is absent in the transfer portion.

2. An image forming apparatus according to claim 1, wherein said controller acquires current information on the current flowing through said transfer member in the case that the target voltage is applied to said transfer member in the state in which the recording material is absent in the transfer portion, and on the basis of the acquired current information, said controller sets the upper limit and the lower limit.

3. An image forming apparatus according to claim 1, wherein said controller acquires a voltage-current characteristic which is a relationship between a current flowing through said transfer member when a voltage is applied to said transfer member in the state in which the recording material is absent in the transfer portion and the applied voltage, and on the basis of the acquired voltage-current characteristic, said controller sets the upper limit and the lower limit.

4. An image forming apparatus according to claim 3, wherein said controller acquires the voltage-current characteristic on the basis of a current flowing through said transfer member or a voltage applied to said transfer member when different voltages or currents of three levels or more are supplied from said voltage source in the state in which the recording material is absent in the transfer portion.

5. An image forming apparatus according to claim 3, wherein said controller is capable of selectively executing a first mode in which said controller acquires the voltage-current characteristic on the basis of a current flowing through said transfer member or a voltage applied to said transfer member when different voltages or currents of three levels or more are supplied from said voltage source in the state in which the recording material is absent in the transfer portion, and a second mode in which said controller acquires the voltage-control characteristic on the basis of a current flowing through said transfer member or a voltage applied to said transfer member when a voltage or a current of a level lower than the levels of said first mode is supplied from said voltage source in the state in which the recording material is absent in the transfer portion and on the basis of a result of said first mode executed in advance.

6. An image forming apparatus according to claim 3, wherein said voltage-current characteristic is represented by a polynomial expression of a quadratic or higher degree in which the current is expressed by the voltage.

7. An image forming apparatus according to claim 1, wherein said controller acquires first current information Inp on the current flowing through said transfer member in the case that the target voltage is applied to said transfer member in the state in which the recording material is absent in the transfer portion and acquires second current information Ip on the basis of the acquired first current information Inp, size information with respect to a widthwise direction substantially perpendicular to a feeding direction of the recording material, and the detection result detected by said current detecting portion at the time when the toner image is transferred onto the recording material, and sets the upper limit and the lower limit on the basis of the acquired second current information Ip.

8. An image forming apparatus according to claim 7, further comprising a storing portion configured to store first range information on the predetermined range depending on a predetermined size-recording material, wherein on the basis of the first range information stored in said storing portion and the size information with respect to the widthwise direction substantially perpendicular to the feeding direction of the recording material passing through the transfer portion during the transfer, said controller acquires second range information on the predetermined range depending on a size of the recording material passing through the transfer portion during the transfer, and sets the upper limit and the lower limit on the basis of the acquired second range information and the acquired second current information Ip.

9. An image forming apparatus according to claim 7, wherein said controller acquires a voltage-current characteristic which is a relationship between a current flowing through said transfer member when a voltage is applied to said transfer member in the state in which the recording material is absent in the transfer portion and the applied voltage, and wherein in a case that an absolute value of a value Vpth exceeds a predetermined threshold, even when a value of a current flowing through said transfer member during the transfer is less than the lower limit, said controller does not increase the absolute value of the voltage applied to said transfer member, wherein the value Vpth is acquired on the basis of the target voltage and voltage information Vbth acquired on the basis of the voltage-current characteristic.

10. An image forming apparatus according to claim 9, wherein said controller acquires the voltage information Vbth on the basis of the voltage-current characteristic and the second current information Ip.

11. An image forming apparatus according to claim 9, wherein the predetermined threshold is set depending on an index relating to a thickness of the recording material.

12. An image forming apparatus according to claim 11, wherein compared to the predetermined threshold for the recording material with a first thickness as the thickness indicated by said index, the predetermined threshold for the recording material with a second thickness, thicker than the first thickness, as the thickness indicated by the index is greater.

13. An image forming apparatus according to claim 1, wherein in a case that an image is formed on a predetermined recording material, said controller sets the upper limit at a first upper limit in a case that a current indicated by current information on the current flowing through said transfer member in a case that the target voltage is applied to said transfer member in the state in which the recording material is absent in the transfer portion is a first current, and sets the upper limit at a second upper limit in a case that a current indicated by current information on the current flowing through said transfer member in the case that the target voltage is applied to said transfer member in the state in which the recording material is absent in the transfer portion is a second current higher than the first current, the first upper limit being lower than the second upper limit.

14. An image forming apparatus according to claim 1, wherein said controller changes the upper limit and the lower limit depending on at least one of an index value relating to a thickness of the recording material and an index value relating to surface roughness of the recording material.

15. An image forming apparatus according to claim 14, wherein said controller changes the upper limit based on a width of the recording material with respect to a direction substantially perpendicular to a recording material feeding direction so that in a case that a thickness of the recording material passing through the transfer portion is a first thickness, a change amount of the upper limit relative to a change of the width of the recording material from a width of a recording material with a maximum width is a first amount and so that in a case that the thickness of the recording material passing through the transfer portion is a second thickness thicker than the first thickness, the change amount of the upper limit is a second amount less than the first amount.

16. An image forming apparatus according to claim 14, wherein in a case that a thickness of the recording material passing through the transfer portion is a first thickness, said controller sets the upper limit at a first upper limit in a case that a width of the recording material with respect to a direction substantially perpendicular to a recording material feeding direction is a first width and sets the upper limit at a second upper limit in a case that the width of the recording material is a second width smaller than the first width, the second upper limit being greater than the first upper limit, wherein in a case that the thickness of the recording material passing through the transfer portion is a second thickness thicker than the first thickness, said controller sets the upper limit at a third upper limit in a case that the width of the recording material is the first width and sets the upper limit at a fourth upper limit in a case that the width of the recording material is the second width, the fourth upper limit being greater than the third upper limit, and wherein a difference between the third upper limit and the fourth upper limit is less than a difference between the first upper limit and the second upper limit.

17. An image forming apparatus according to claim 14, wherein in a case that a thickness of the recording material passing through the transfer portion is a predetermined thickness or more, said controller sets the upper limit and the lower limit on the basis of the thickness of the recording material passing through the transfer portion.

18. An image forming apparatus comprising:

an image bearing member configured to bear a toner image;

an intermediary transfer belt onto which the toner image is transferred from said image bearing member;

a transfer member, to which a voltage is applied, configured to transfer the toner image from said intermediary transfer belt onto a recording material in a transfer portion;

a voltage source configured to apply the voltage to said transfer member;

a current detecting portion configured to detect a current flowing through said transfer member;

a correction portion configured to correct a detection result detected by said current detecting portion on the basis of a current flowing through said transfer member when the voltage is applied to said transfer member or a voltage applied to said transfer member when a current is supplied to said transfer member in a state in which the recording material is absent in the transfer portion; and a controller configured to perform constant-voltage control so that the voltage applied to said transfer member becomes a target voltage in a case in which the corrected detection result is within a predetermined range determined based on the type of the recording material while the recording material is passing through the transfer portion, wherein in a case in which the corrected detection result is out of the predetermined range while the recording material is passing through the transfer portion, the controller is configured to adjust the target voltage so that the corrected detection result falls within the predetermined range, and perform the constant voltage control with the adjusted target voltage.

19. An image forming apparatus according to claim 18, wherein said correction portion is configured to correct the detection result detected by said current detecting portion on the basis of a voltage-current characteristic of said transfer member obtained by applying a voltage to said transfer member in a state in which no recording material is present in the transfer portion.

20. An image forming apparatus according to claim 18, wherein said correction portion acquires current information relating to a current flowing through said transfer member in a case that the target voltage is applied to said transfer member in the state in which the recording material is absent in the transfer portion, and said correction portion corrects the detection result detected by said current detecting portion to a first correction value in a case that a current indicated by the acquired current information is a first current, and corrects the detection result detected by said current detecting portion to a second correction value less than the first correction value in a case that a current indicated by the acquired current information is a second current higher than the first current.

21. An image forming apparatus comprising:

an image bearing member configured to bear a toner image;

an intermediary transfer belt onto which the toner image is transferred from said image bearing member;

a transfer member, to which a voltage is applied, configured to transfer the toner image from said intermediary transfer belt onto a recording material in a transfer portion;

a voltage source configured to apply the voltage to said transfer member;

a current detecting portion configured to detect a current flowing though said transfer member; and a controller configured to perform constant-voltage control so that the voltage applied to said transfer member becomes a target voltage in a case in which a detection result detected by said current detecting portion is within a predetermined range determined based on a type of the recording material while the recording material is passing through the transfer portion, wherein in a case in which the detection result is out of the predetermined range while the recording material is passing through the transfer portion, said controller is configured to adjust the target voltage so that the detection result falls within the predetermined range, and perform the constant voltage control with the adjusted target voltage, and wherein said controller sets an upper limit of the predetermined range on the basis of a current flowing through said transfer member when the voltage is applied to said transfer member or a voltage applied to said transfer member when a current is supplied to said transfer member, in a state in which the recording material is absent in the transfer portion.

22. An image forming apparatus according to claim 21, wherein said controller acquires current information on the current flowing through said transfer member in the case that the target voltage is applied to said transfer member in the state in which the recording material is absent in the transfer portion, and on the basis of the acquired current information, said controller sets the upper limit and the lower limit.

23. An image forming apparatus according to claim 21, wherein said controller acquires a voltage-current characteristic which is a relationship between a current flowing through said transfer member when a voltage is applied to said transfer member in the state in which the recording material is absent in the transfer portion, and on the basis of the acquired voltage-current characteristic, said controller sets the upper limit and the lower limit.

24. An image forming apparatus according to claim 21, wherein said controller acquires first current information Inp on the current flowing through said transfer member in the case that the target voltage is applied to said transfer member in the state in which the recording material is absent in the transfer portion and acquires second current information Ip on the basis of the acquired first current information Inp, size information with respect to a widthwise direction substantially perpendicular to a feeding direction of the recording material, and the detection result detected by said current detecting portion at the time when the toner image is transferred onto the recording material, and sets the upper limit and the lower limit on the basis of the acquired second current information Ip.

25. An image forming apparatus comprising:

an image bearing member configured to bear a toner image;

an intermediary transfer belt onto which the toner image is transferred from said image bearing member;

a transfer member, to which a voltage is applied, for transferring the toner image from said intermediary transfer belt onto a recording material in a transfer portion;

a voltage source configured to apply the voltage to said transfer member;

a current detecting portion configured to detect a current flowing though said transfer member; and a controller configured to perform constant-voltage control so that the voltage applied to said transfer member becomes a target voltage in a case in which a detection result detected by said current detecting portion is within a predetermined range determined based on the type of the recording material while the recording material is passing through the transfer portion, wherein in a case in which the detection result is out of the predetermined range while the recording material is passing through the transfer portion, said controller is configured to adjust the target voltage so that the detection result falls within the predetermined range, and perform the constant voltage control with the adjusted target voltage, and wherein said controller sets a lower limit of the predetermined range on the basis of a current flowing through said transfer member when the voltage is applied to said transfer member or a voltage applied to said transfer member when a current is supplied to said transfer member, in a state in which the recording material is absent in the transfer portion.

26. An image forming apparatus according to claim 25, wherein said controller acquires current information on the current flowing through said transfer member in the case that the target voltage is applied to said transfer member in the state in which the recording material is absent in the transfer portion, and on the basis of the acquired current information, said controller sets the upper limit and the lower limit.

27. An image forming apparatus according to claim 25, wherein said controller acquires a voltage-current characteristic which is a relationship between a current flowing through said transfer member when a voltage is applied to said transfer member in the state in which the recording material is absent in the transfer portion, and on the basis of the acquired voltage-current characteristic, said controller sets the upper limit and the lower limit.

28. An image forming apparatus according to claim 25, wherein said controller acquires first current information Inp on the current flowing through said transfer member in the case that the target voltage is applied to said transfer member in the state in which the recording material is absent in the transfer portion and acquires second current information Ip on the basis of the acquired first current information Inp, size information with respect to a widthwise direction substantially perpendicular to a feeding direction of the recording material, and the detection result detected by said current detecting portion at the time when the toner image is transferred onto the recording material, and sets the upper limit and the lower limit on the basis of the acquired second current information Ip.

* * * * *